US012420999B2

(12) United States Patent
Schäfer et al.

(10) Patent No.: US 12,420,999 B2
(45) Date of Patent: Sep. 23, 2025

(54) INKJET PRINTABLE TWIST AND/OR FOLD WRAP FILMS FOR PACKAGING APPLICATIONS

(71) Applicant: Sihl GmbH, Düren (DE)

(72) Inventors: Manfred Schäfer, Cologne (DE); Axel Niemöller, Düren (DE); Ronny Kunze, Schenkelberg (DE); Steffen Ohr, Sursee (CH)

(73) Assignee: Sihl GmbH, Düren (DE)

( * ) Notice: Subject to any disclaimer, the term of this patent is extended or adjusted under 35 U.S.C. 154(b) by 287 days.

(21) Appl. No.: 18/089,031

(22) Filed: Dec. 27, 2022

(65) Prior Publication Data

US 2023/0202727 A1 Jun. 29, 2023

(30) Foreign Application Priority Data

Dec. 28, 2021 (EP) ..... 21217999

(51) Int. Cl.

| | |
|---|---|
| ***B65D 65/22*** | (2006.01) |
| ***B65D 65/16*** | (2006.01) |
| ***B65D 65/42*** | (2006.01) |
| ***B65D 65/46*** | (2006.01) |

(52) U.S. Cl.

CPC ..... *B65D 65/22* (2013.01); *B65D 65/16* (2013.01); *B65D 65/42* (2013.01); *B65D 65/466* (2013.01); *B65D 2565/382* (2013.01)

(58) Field of Classification Search

CPC ..... B65D 65/22; B65D 65/16; B65D 65/42; B65D 65/466; B65D 2565/382

USPC ..... 229/87.01

See application file for complete search history.

(56) References Cited

U.S. PATENT DOCUMENTS

| | | | |
|---|---|---|---|
| 5,128,183 | A | 7/1992 | Buzio |
| 8,057,911 | B2 | 11/2011 | Lohr |
| 11,400,744 | B2 | 8/2022 | Schafer et al. |
| 2017/0028688 | A1 | 2/2017 | Dannhauser et al. |
| 2019/0152209 | A1 | 5/2019 | Ikeda et al. |

FOREIGN PATENT DOCUMENTS

| | | | |
|---|---|---|---|
| EP | 1080877 | A2 | 3/2001 |
| EP | 1661693 | A1 | 5/2006 |
| EP | 3492271 | A1 | 6/2019 |
| EP | 3628505 | A1 | 4/2020 |

*Primary Examiner* — Peter N Helvey
(74) *Attorney, Agent, or Firm* — The Webb Law Firm

(57) ABSTRACT

The present invention relates to inkjet printable twist and/or fold wrap film for packaging applications, to inkjet printed twist and/or fold wrap film for packaging applications, to packaging including said inkjet printable or inkjet printed twist and/or fold wrap film, the use of the inkjet printable or inkjet printed twist and/or fold wrap film for as well as to the method of making a filled packaging.

17 Claims, 2 Drawing Sheets

INKJET PRINTABLE TWIST AND/OR FOLD WRAP FILMS FOR PACKAGING APPLICATIONS

CROSS-REFERENCE TO RELATED APPLICATION

This application claims priority to European Patent Application No. 21 217 999.8 filed Dec. 28, 2021, the disclosure of which is hereby incorporated by reference in its entirety.

BACKGROUND OF THE INVENTION

Field of the Invention

The present invention relates to inkjet printable twist and/or fold wrap film for packaging applications, to inkjet printed twist and/or fold wrap film for packaging applications, to packaging comprising said inkjet printable or inkjet printed twist and/or fold wrap film, the use of the inkjet printable or inkjet printed twist and/or fold wrap film for as well as to the method of making a filled packaging.

Description of Related Art

For the packaging of individual small goods such as sweets, chewing gum and the like, it is known to wrap the goods with a film and then to close the open ends by twisting forming a twist wrap film or to wrap the goods with the film and then close by folding forming a fold wrap film.

EP 1 661 693 A1 relates to a film material produced by coextrusion of a number of plastic layers. One or more plastic layers consist of partially crystalline polyolefins. A further plastic layer consists of an amorphous cycloolefin copolymer, and the different types of layers are in direct contact with one another.

EP 1 080 877 A2 refers to a foil for packaging smaller articles comprising a central area for wrapping around such article, and surrounding area which is provided with an adhesive layer allowing the foil to be simply and securely closed around the article.

U.S. Pat. No. 5,128,183 is directed to modified polyolefin films with stable twist retention and dead fold properties to be employed in wrapping small items.

It is desirable to provide a film having good twist retention and/or dead fold retention, which can be printed with (aqueous) inks in high-speed inkjet printing resulting high quality water-resistant prints. Furthermore, it is desirable to provide a film exhibiting a high crack resistance as wells as sealing properties as required for packaging applications while maintaining the twist or fold wrap. In addition, it is desirable to provide a film having good moisture and/or oxygen barrier properties to ensure good packaging of goods useful for storage. Furthermore, it is desirable for the film to be compostable, while being sufficiently stiff to form an effective packaging on typical modern high-speed pack forming and filling machinery. It is further desirable for the film to be environmentally friendly and sustainable. It is also desirable to provide a printed film having good rub resistance as well as soiling resistance, while exhibiting good twist retention and/or dead fold retention.

These objects are met by the inkjet printable twist and/or fold wrap film and methods of the present invention.

SUMMARY OF THE INVENTION

The following clauses summarise some aspects of the present invention.

A first aspect of the present invention relates to an inkjet printable twist and/or fold wrap film for packaging applications comprising:

(a) a non-oriented polymer film, wherein the non-oriented polymer film (a) is a regenerated cellulose film;

(b) at least one ink-receiving layer comprising inorganic particles and a binder coated over one surface of the non-oriented polymer film (a) at a dry coating weight being in the range of from 8 to 30 g/m$^2$; and (c) an adhesion promoting layer between the non-oriented polymer film (a) and the at least one ink-receiving layer (b).

A second aspect of the present invention relates to the inkjet printable twist and/or fold wrap film according to the first aspect, wherein the inkjet printable twist and/or fold wrap film without the ink-receiving layer has a film thickness in the range of from 15 to 50 μm.

A third aspect of the present invention relates to the inkjet printable twist and/or fold wrap film according to the first aspect or second aspect, wherein the non-oriented polymer film (a) is transparent, translucent, metallized or opaque.

A fourth aspect of the present invention relates to the inkjet printable twist and/or fold wrap film according to any one of the preceding aspects, wherein the inorganic particles comprise aluminum oxide particles, aluminum hydroxide particles, silica particles, or combinations thereof, preferably aluminum oxide, aluminum oxide hydroxide, fumed silica, colloidal silica, cationic silica, precipitated silica, gel type silica, calcium carbonate or combinations thereof, more preferably boehmite.

A fifth aspect of the present invention relates to the inkjet printable twist and/or fold wrap film according to any one of the preceding aspects, wherein the binder comprises polyvinyl alcohol, polyvinyl alcohol derivatives, polyethylene oxide, polyvinylmethylether, cellulose derivatives, such as methylcellulose, ethylcellulose, and carboxymethylcellulose, polyvinylpyrrolidone, polymer dispersions or emulsions such as acrylic dispersions, styrene-acrylic dispersions, vinylacetate dispersions, ethylene-vinylacetate dispersions, and polyurethane dispersions; or combinations thereof, preferably polyvinyl alcohol; polyvinyl alcohol derivatives; or combinations thereof.

A sixth aspect of the present invention relates to the inkjet printable twist and/or fold wrap film according to any one of the preceding aspects, wherein the ink-receiving layer (b) comprises the inorganic particles and the binder in a weight ratio ranging from 2:1 to 20:1, preferably from 3:1 to 15:1, more preferably from 7.5:1 to 14:1, and even more preferable from 8:1 to 12:1.

A seventh aspect of the present invention relates to the inkjet printable twist and/or fold wrap film according to any one of the preceding aspects, wherein the ink-receiving layer (b) comprises a crosslinking agent, wherein the crosslinking agent preferably comprises boric acid, borate, dialdehydes such as glyoxal, glyoxylic acid, salts of glyoxylic acid such as sodium or calcium salts, dihydrazides such as adipic acid dihydrazide, di- or polyols such as methylolmelamine, urea glyoxyl resin or urea glyoxal resins, polyvalent metal salts such as zirconates or titanates, compounds having silanol groups or combinations thereof, more preferably boric acid, borate, dialdehydes such as glyoxal, glyoxylic acid, salts of glyoxylic acid such as sodium or calcium salts, dihydrazides such as adipic acid dihydrazide, di- or polyols such as methylolmelamine, urea glyoxyl resin or urea glyoxal resins, compounds having silanol groups or combinations thereof.

An eighth aspect of the present invention relates to the inkjet printable twist and/or fold wrap film according to any one of the preceding aspects, wherein polyvinyl alcohol is the sole binder polymer in the ink-receiving layer (b).

A ninth aspect of the present invention relates to the inkjet printable twist and/or fold wrap film according to any one of the preceding aspects, wherein the ink-receiving layer (b) comprises boehmite and an acidic dispersing agent, wherein the acidic dispersing agent preferably is an organic and/or inorganic acid having a $pk_a$ value lower than 5.0; more preferably an inorganic acid having a $pk_a$ of less than 2.0 such as hydrochloric acid.

A tenth aspect of the present invention relates to the inkjet printable twist and/or fold wrap film according to any one of the preceding aspects, wherein the adhesion promoting layer (c) comprises (co)polyester, polyvinylidene chloride, vinylchloride vinylacetate copolymer, (meth)acrylic (co)polymer, nitrocellulose, ethylene acrylic acid copolymer, or copolymers or combinations thereof; preferably (co)polyester, wherein the (co)polyester preferably comprises polyhydroxyalkanoates such as poly(3-hydroxypropionate), poly(3-hydroxybutyrate), poly(3-hydroxyvalerate) or (poly(3-hydroxybutyrate-co-3-hydroxyvalerate); polybutylene succinate; polylactic acid; an aliphatic-aromatic copolyester such as poly(ethylene glutarate-co-terephthalate), poly(tetramethylene glutarate-co-terephthalate), poly(tetramethylene glutarate-co-terephthalate-co-diglycolate), poly(ethylene adipate-co-terephthalate), poly(tetramethylene succinate-co-terephthalate), poly(ethylene glutarate-co-naphthalene dicarboxylate), poly(tetramethylene glutarate-co-naphthalene dicarboxylate), poly(tetramethylene adipate-co-naphthalene dicarboxylate), poly(ethylene adipate-co-naphthalene dicarboxylate), poly(tetramethylene succinate-co-naphthalene dicarboxylate), or poly(ethylene succinate-co-naphthalene dicarboxylate); polyethylene 2,5-furandicarboxylate; or copolymers or combinations thereof.

An eleventh aspect of the present invention relates to the inkjet printable twist and/or fold wrap film according to any one of the preceding aspects further comprising a barrier layer positioned between the non-oriented polymer film (a) and the ink-receiving layer (b) and/or over the surface of the non-oriented polymer film (a) opposite to the surface over which the ink-receiving layer (b) is formed.

A twelfth aspect of the present invention relates to the inkjet printable twist and/or fold wrap film according to the eleventh aspect, wherein the barrier layer comprises metal, metal oxide, or a polymer film comprising polyvinylidene chloride, polylactic acid, polyvinyl alcohol, polyvinyl alcohol derivatives or ethylene vinyl alcohol copolymers.

A thirteenth aspect of the present invention relates to the inkjet printable twist and/or fold wrap film according to the eleventh aspect or twelfth aspect, wherein the barrier layer is a moisture barrier layer and/or an oxygen barrier layer.

A fourteenth aspect of the present invention relates to the inkjet printable twist and/or fold wrap film according to any one of the preceding aspects further comprising a sealing layer positioned over the surface of the non-oriented polymer film (a) opposite to the surface over which the ink-receiving layer (b) is formed.

A fifteenth aspect of the present invention relates to the inkjet printable twist and/or fold wrap film according to the fourteenth aspect, wherein the sealing layer is a heat-sealing layer, a layer for ultrasonic sealing, a layer for solvent sealing or a pressure-sealing layer.

A sixteenth aspect of the present invention relates to the inkjet printable twist and/or fold wrap film according to the fourteenth aspect or fifteenth aspect, wherein the sealing layer has a thickness of 0.5 to 5 μm.

A seventeenth aspect of the present invention relates to the inkjet printable twist and/or fold wrap film according to any one of the preceding aspects having a twist retention of more than 350°.

An eighteenth aspect of the present invention relates to the inkjet printable twist and/or fold wrap film according to any one of the preceding aspects having a dead fold retention of at least 100°, preferably of at least 140°.

A nineteenth aspect of the present invention relates to the inkjet printable twist and/or fold wrap film according to any one of the preceding aspects having a thickness of from 20 to 100 μm, preferably 20 to 80 μm, more preferably from 23 to 80 μm.

A twentieth aspect of the present invention relates to the inkjet printable twist and/or fold wrap film according to any one of the preceding aspects comprising up to 50 wt.-% of the ink-receiving layer (b), based on the total weight of the inkjet printable twist and/or fold wrap film.

A twenty-first aspect of the present invention relates to the inkjet printable twist and/or fold wrap film according to any one of the preceding aspects having a permeability to water vapor of 300 $g/m^2$ or less, preferably of from 3 to 200 $g/m^2$, determined according to ASTM E96-16 (per 24 h at 38° C. and 90% RH) and/or a permeability to oxygen of 15 $mL/m^2$ or less, preferably of from 1 to 10 $mL/m^2$, determined according to ASTM F 1927-20 (per 24 h at 23° C. and 50% RH).

A twenty-second aspect of the present invention relates to the inkjet printable twist and/or fold wrap film according to any one of the preceding aspects being industrially compostable and/or home compostable, preferably industrially compostable.

A twenty-third aspect of the present invention relates to the inkjet printable twist and/or fold wrap film according to any one of the preceding aspects exhibiting a coefficient of friction (CoF) film to film of the surface opposite to the side of the ink-receiving layer to itself of less than 0.45, preferably in the range of from 0.15 to 0.45.

A twenty-fourth aspect of the present invention relates to a method for preparing the inkjet printable twist and/or fold wrap film according to any one of the preceding aspects comprising the steps:

(a) providing a non-oriented polymer film being a regenerated cellulose film;
(b) applying an adhesion promoting layer over at least a part of one surface of the non-oriented film (a);
(c) coating the surface of the non-oriented polymer film comprising the adhesion promoting layer (b) with a ink-receiving layer composition comprising inorganic particles and a binder at a dry coating weight being in the range of 8 to 30 $g/m^2$.

A twenty-fifth aspect of the present invention relates to an inkjet printed twist and/or fold wrap film obtained by printing of the inkjet printable twist and/or fold wrap film according to any one of the first to the twenty-third aspects or prepared by the method according to the twenty-fourth aspect and further applying an overprint varnish layer (d) as an outer layer over the printed ink-receiving layer (b).

A twenty-sixth aspect of the present invention relates to the inkjet printed twist and/or fold wrap film according to the twenty-fifth aspect printed by means of inkjet printing, preferably using water-based inks, more preferably water-based pigmented inks.

A twenty-seventh aspect of the present invention relates to the inkjet printed twist and/or fold wrap film according to the twenty-fifth or the twenty-sixth aspect, wherein the overprint varnish layer (d) has a thickness of 0.5 to 5 μm.

A twenty-eighth aspect of the present invention relates to the inkjet printed twist and/or fold wrap film according to the twenty-fifth to the twenty-seventh aspects further comprising a sealing layer opposite to the surface over which the ink-receiving layer (b) is formed.

A twenty-ninth aspect of the present invention relates to the inkjet printed twist and/or fold wrap film according to the twenty-fifth to the twenty-eighth aspects having a twist retention of more than 350°.

A thirtieth aspect of the present invention relates to the inkjet printed twist and/or fold wrap film according to the twenty-fifth to the twenty-ninth aspects having a dead fold retention of at least 100°, preferably of at least 140°.

A thirty-first aspect of the present invention relates to the inkjet printed twist and/or fold wrap film according to the twenty-fifth to the thirtieth aspects exhibiting a coefficient of friction (CoF) film to film of the surface on the side of the ink-receiving layer to itself and/or the surface opposite to the side of the ink receiving layer to itself of less than 0.45, preferably in the range of from 0.15 to 0.45, preferably of both the surface on the side of the ink-receiving layer to itself and the surface opposite to the side of the ink receiving layer to itself of less than 0.45, preferably in the range of from 0.15 to 0.45.

A thirty-second aspect of the present invention relates to the inkjet printed twist and/or fold wrap film according to the twenty-fifth to the thirty-first aspects being industrially compostable and/or home compostable, preferably industrially compostable.

A thirty-third aspect of the present invention relates to a method for preparing the inkjet printed twist and/or fold wrap film according to the twenty-fifth to the thirty-second aspects comprising the steps:

(a) providing the inkjet printable twist and/or fold wrap film according to any one of first to the twenty-third aspects or prepared by the method according to the twenty-fourth aspect;

(b) printing of the ink-receiving layer of the inkjet printable twist and/or fold wrap film; and (c) applying an overprint varnish as an outer layer over the printed ink-receiving layer.

A thirty-fourth aspect of the present invention relates to a packaging comprising the inkjet printable twist and/or fold wrap film according to any one of first to the twenty-third aspects or the printed inkjet printable flexible film according to any one of the twenty-fifth to thirty-second aspects.

A thirty-fifth aspect of the present invention relates to use of an inkjet printable twist and/or fold wrap film according to any one of the first to twenty-third aspects for preparing a packaging for food, pet food, beverages, pharmaceuticals and/or personal care products, preferably for food.

A thirty-sixth aspect of the present invention relates to use of an inkjet printed twist and/or fold wrap film according to any one of the twenty-fifth to thirty-second aspects, or a packaging according to the thirtieth-fourth aspect for packaging food, pet food, beverages, pharmaceuticals and/or personal care products, preferably for packaging food.

A thirty-seventh aspect of the present invention relates to a method of making a filled packaging comprising the steps of:

(i) providing the inkjet printed twist and/or fold wrap film according to any one the twenty-fifth to thirty-second aspects or prepared by the method according to the thirty-third aspect;

(ii) positioning goods onto the inkjet printed twist and/or wrap film;

(iii) wrapping the goods with the inkjet printed twist and/or wrap film and closing the wrapping by means of twisting or folding the inkjet printed twist and/or wrap film around the goods;

(iv) optionally partially sealing the packaging film.

The inventive inkjet printable (optionally inkjet printed) twist and/or fold wrap film has a high print quality, particularly high resolution without print artefacts, at high-speed printing, provides good twist and/or dead fold retention and has excellent mechanical stability. It exhibits a high cohesion and adhesion of the ink receiving layer and the applied ink, which can withstand high mechanical stresses while maintaining the film's twist and/or fold wrap for packaging. The twist and/or fold wrap film can be manufactured easily and can be printed via high-speed inkjet printing. Furthermore, the twist and/or fold wrap film may exhibit sufficiently low coefficient of friction (CoF) necessary for use in twist and fold wrap machines, and may also be antistatic, which ensures good passing in machines. Furthermore, the films according to the invention can be biodegradable, allowing the possibility of industrial compostability or home compostability.

DESCRIPTION OF THE INVENTION

Figure 1:
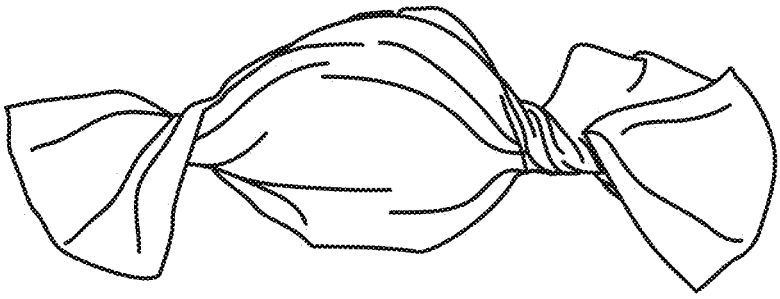
FIG. 1 shows goods wrapped in an inkjet printed twist and/or fold wrap film according to the present invention.
Figure 2:
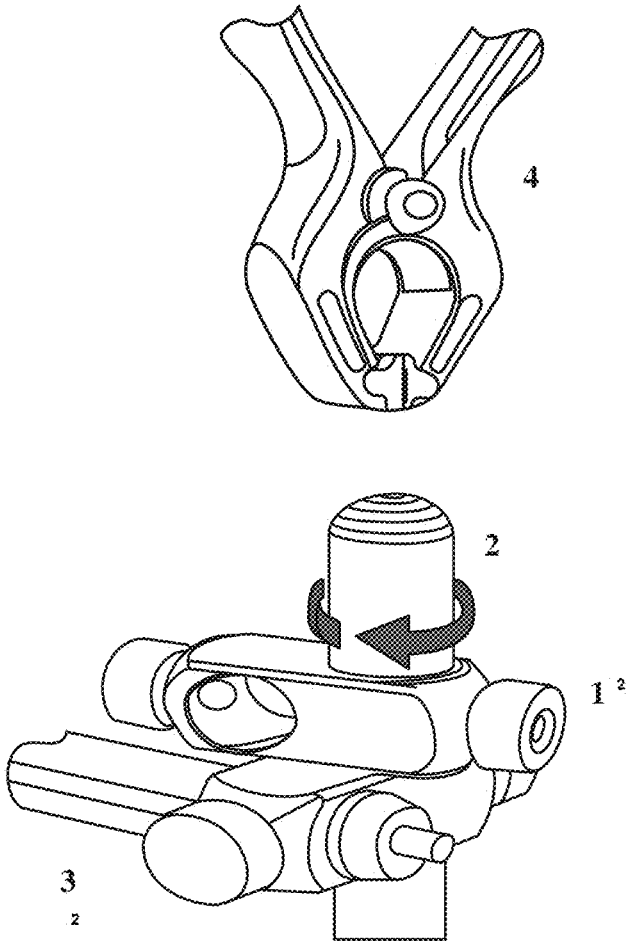
FIG. 2 (not to scale) shows a schematic apparatus/test setup to determine the twist retention of film samples. The test setup includes a (first) upper cross clamp (1) with a rod (2) fastened therein, wherein the shorter side of the rod passes through one of the two tunnels of a (second) lower cross clamp (3) and the side of the rod protruding 3 cm from the (first) upper cross clamp faces upwards. A spring clamp (4) is located above the upper end of the rod protruding 3 cm from the (first) upper cross clamp.
Figure 3:
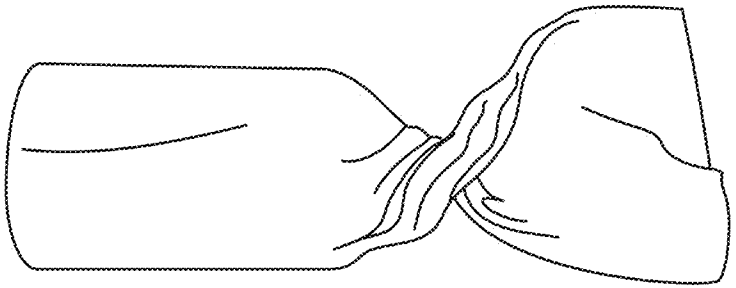
FIG. 3 shows an inkjet printed twist and/or fold wrap film according to the present invention after determining the twist retention. The inkjet printed twist and/or fold wrap film shows a vertical line marked with a foil pen.

The present invention relates to an inkjet printable twist and/or fold wrap film for packaging applications. The inkjet printable twist and/or fold wrap film of the present invention comprises (a) a non-oriented polymer film; (b) at least one ink-receiving layer comprising inorganic particles and a binder coated over one surface of the non-oriented polymer film (a); and (c) an adhesion promoting layer between the non-oriented polymer film (a) and the at least one ink-receiving layer (b). According to the present invention, the non-oriented polymer film is a regenerated cellulose film. The ink-receiving layer of the present invention is coated at a dry coating weight being in the range of from 8 to 30 $g/m^2$. The ink receiving layer (b) and the adhesion promoting layer are distinct layers of different compositions.

As used herein, the term "regenerated cellulose" refers to a class of well-known polymer formed by precipitation of cellulose, such as from wood, cotton, hemp or other sources, from its solution. Regenerated cellulose may be prepared by viscose process including first derivatizing cellulose with carbon disulfide and sodium hydroxide to an alkali-soluble sodium cellulose xanthane, commonly known as viscose, which is further dissolved in dilute sodium hydroxide. The viscose liquid is extruded into a bath of sulphuric acid and sodium sulphate to reconvert it to solid cellulose resulting regenerated cellulose after completion of the viscose process, which is called cellophane, when the regenerated cellulose is in film form. Suitable examples of regenerated cellulose films include NatureFlex™ films, such as NatureFlex™ NK White, NatureFlex™ NKM, NatureFlex™ NVS White, NatureFlex™ XS, and Cellophane™ films, such as Cellophane™ WSBZ and Cellophane™ XS, all available from Futamura Group (Great Britain).

The inkjet printable twist and/or fold wrap film without the ink-receiving layer (b) typically has a thickness being in the range of from 15 to 50 μm, preferably of from 15 to 48 μm, more preferably of from 15 to 45 μm, even more preferably 15 to 40 μm, most preferably from 15 to 35 μm.

The non-oriented polymer film (a) can be transparent, translucent, metallized or opaque, e.g. white opaque. Suitable films can be dyed in the mass, e.g. with a white pigment such as titanium dioxide, barium sulfate or calcium carbonate. The surface(s) of the non-oriented polymer film (a) can be treated, e.g. by corona treatment, flame treatment, or chemical treatment. The treatment of the surface can have various effects such as an improvement of wettability and adhesion to the adjacent layers, and thus results in an increase of composite strength.

As used herein, the term "ink-receiving layer" refers to a coating provided over the non-oriented polymer film (a) which is capable of receiving an ink. The at least one ink-receiving layer (b) is coated over one surface of the non-oriented film (a) and comprises inorganic particles in order to achieve a high porosity microporous structure for fast ink uptake in the printing process, and a binder.

According to the present invention, the ink-receiving layer (b) can comprise any inorganic particle suitable and/or commonly used in ink-receiving coatings, in particular in coatings provided to be printed by inkjet printers with aqueous inkjet inks. The suitability originates from the ability of the particles to provide a high porous microporous coating. As used herein, the terms "high porous" or "high porosity" refers to coatings having a porosity of at least 0.3 to 1.5 mL/g, or 0.35 to 1.2 mL/g, preferably 0.4 to 1 mL/g, or 0.45 to 0.9 mL/g, more preferably 0.5 to 0.9 mL/g. By the term "microporous" is meant that the pores between the (primary) particles, within particle aggregates and/or the particles and the binder (before the ink-receiving layer (b) is printed with ink) have a mean pore size (diameter) in the range of from 2 to 500 nm, preferably in the range of from 5 to 200 nm, even more preferably of from 10 to 100 nm as can be measured by mercury intrusion porosimetry.

The inorganic particles of the present invention may have a mean dispersed particle size in the range of 20 to 350 nm, preferably 30 to 300 nm, more preferably from 40 to 250 nm, even more preferably from 50 to 200 nm and most preferred from 60 to 180 nm, as determined by light diffraction method according to ISO 13320:2009.

Suitably, the inorganic particles of the ink-receiving layer (b) have a BET surface of 100 to 350 $m^2/g$, preferably of 100 to 300 $m^2/g$, more preferably of 100 to 250 $m^2/g$.

According to the present invention, the inorganic particles may comprise aluminum oxide particles, aluminum hydroxide particles, silica particles, or combinations thereof. Preferably the inorganic particles may comprise aluminum oxide, aluminum oxide hydroxide such as boehmite and pseudo-boehmite, fumed silica, colloidal silica, cationic silica, precipitated silica, gel type silica, calcium carbonate or combinations thereof, more preferably aluminum oxide, boehmite, fumed silica or combinations thereof, even more preferably boehmite. The inorganic particles may comprise other inorganic components and may be surface modified by inorganic or organic compounds.

Boehmite is a mineral of aluminum with an orthorhombic unit cell (a=3.693° A, b=12.221° A, and c=2.865° A), classified as aluminum oxide hydroxide (γ-AlO(OH) (=$Al_2O_3 \cdot H_2O$)). Its crystal structure consists of double layers of oxygen octahedrons with a central aluminum atom. The outfacing oxygen is bonded via hydrogen bonds to the hydroxyl group of the adjacent layer of octahedrons. Due to the weak bonds, boehmite is prone to intercalation, that is, the inclusion of small molecules, usually water, in between these layers. This causes a larger spacing in [010] direction and a perfect cleavage perpendicular to the general direction of the hydrogen bonding. Boehmite with an increased spacing in the [010] direction is referred to as pseudo-boehmite and amorphous boehmite is usually referred to as gel. Pseudo-boehmite is characterized by a higher water content ($Al_2O_3 * xH_2O$ ($1.0<x<2.0$)). Boehmite can be found in nature or precipitated and grown from solution of aluminum salts and alumina under hydrothermal conditions.

Boehmite particles within the meaning of the present invention are small primary aggregates of boehmite crystallites.

The crystallite size might be from 1 to 100 nm, preferably from 7 to 80 nm, more preferably from 8 to 60 nm, as determined by X-Ray diffraction on X-Ray diffractometers supplied by Siemens of Philips. The term "crystallite" refers to the domain of coherent crystal structure. A particle may be made up of several different crystallites or just one crystallite, whereby the particle size would be equal to the crystallite size. The small primary aggregates of boehmite crystallites can be obtained by dispersion of secondary larger agglomerates of boehmite crystallites having a mean particle size in the range of from 1 μm to 100 μm present in commercially available boehmite powders, e.g. as delivered from a spray drying process. The dispersed boehmite particles (small primary aggregates of boehmite crystallites) typically have a particle size ($d_{50}$, volume mean) in the range of from 30 nm to 300 nm, preferably from 50 nm to 200 nm, more preferably from 80 to 180 nm, as determined by photon correlation spectroscopy on Malvern, Horiba or Cilias instruments after dispersion of the boehmite powder in acidic solution (10 wt.-% of $Al_2O_3$ in 0.4 wt.-% of $HNO_3$). The particles size distribution is preferably unimodal.

Suitable examples of boehmite particles include DISPERAL® and DISPAL® grades available from Sasol (South Africa), e.g. the grades HP8, HP10, HP14, HP18, HP22, HP30 and HP80.

Suitable examples of aluminum oxide particles include AERODISP® grades available from Evonik Operations GmbH (Germany), such as AERODISP® W 925, AERODISP® W 630, and AERODISP® W 440. Suitable examples of colloidal silica include Cartacoat® K grades from Clariant (Switzerland), such as Cartacoat® K 303. These silica particles have an anionic, hydrophobic surface and should be cationic modified to obtain dispersible silica particles, as described below. Suitable examples of cationic silicas include SNOWTEX® grade available from Nissan Chemical Corporation (Japan).

As a binder according to the present invention any binder known to allow the formation of a porous structure in ink-receiving layers (b) can be used. There is no particular limitation concerning the binder, as long as the "high porous microporous" structure of the present invention can be obtained. Binders for use in preparing ink-receiving layers (b) are well known in the art. According to the present invention, the binder may comprise polyvinyl alcohol; polyvinyl alcohol derivatives; polyethylene oxide; polyvinylmethylether; cellulose derivatives, such as methylcellulose, ethylcellulose, and carboxymethylcellulose; polyvinylpyrrolidone; polymer dispersions or emulsions such as acrylic dispersions, styrene-acrylic dispersions, vinylacetate dispersions, ethylene-vinylacetate dispersions and polyurethane dispersions or combinations thereof. According to the present invention, polyvinyl alcohol, polyvinyl alcohol derivatives or combinations thereof are preferred. Polyvinyl alcohol may be the sole binder polymer in the ink-receiving layer (b), i.e. no other polymer is present in the ink-receiving layer (b) apart from any optional polymeric particles as described below.

As used herein, the term "polyvinyl alcohol" is generally acknowledged in the art as a completely or partially hydrolyzed polyvinyl acetate. The degree of hydrolysis attributed to a polyvinyl alcohol designates the degree of hydrolysis of the polyvinyl acetate in accordance with standard practice. Depending on the inorganic particle used for preparing the ink-receiving layer (b), the hydrolyzation degree as well as the molecular weight of polyvinyl alcohol has to be chosen in order to achieve a homogeneous coating, no coating artefacts as e.g. cracking, good cohesion of the coating and high porosity.

The degree of hydrolysis may be from 78 to 100 mol-%, preferably from 80 to 96 mol-%, more preferably from 82 to 94 mol-%, even more preferably from 84 to 93 mol-%, and most preferably from 86 to 92.5 mol-%.

As used herein, the term "degree of hydrolysis (saponification)" refers to the ratio of a hydroxyl group with respect to the total number of the hydroxyl group and a carbonyloxy group such as an acetyloxy group in the polyvinyl alcohol. The degree of hydrolysis of the polyvinyl alcohol has to be understood as an average value, meaning that mixtures of less hydrolyzed and more hydrolyzed polyvinyl alcohols can be used as well.

Accordingly, the preferred viscosity of a freshly produced 4 wt.-% aqueous solution of the polyvinyl alcohol at 20° C. determined by a Höppler falling ball viscometer following DIN 53015 is from 15 to 150 mPa·s, more preferably from 25 to 80 mPa·s.

Suitable polyvinyl alcohol derivatives include derivatives providing crosslinkable and/or reactive groups. As used herein, the term "derivative" is meant that the polymer comprises groups modifying the chemical basic structure of the polymer, e.g. pendant groups or co-polymerized monomers providing the polymer additional properties or characteristics.

Suitable examples of polyvinyl alcohol include, but are not limited to, Poval™ grades, e.g. Poval™ 40-88, Poval™ 56-88, Poval™ 25-98 R, Poval™ 26-88, Poval™ 30-92, available from Kuraray (Japan). Polyvinyl alcohol with silanol modification such as, e.g. Kuraray Poval™ 25-98 R are able to crosslink by itself after drying or crosslink with OH-groups of the particles used for the microporous coating, e.g. fumed silica.

Keto group containing modified polyvinyl alcohols may be used as the binder, since the keto group can be crosslinked by means of a chemical crosslinker. Such polyvinyl alcohol derivatives or copolymers preferably comprise 0.5 to 5% of a side group bearing the keto function. These groups can be included by copolymerizing or achieved by polymer analogous modification of the polyvinyl alcohol. An example of a monomer for copolymerization is diacetone acrylamide, e.g available from Japan VAM & Poval Co., Ltd. (Japan) as Poval™ D series. Aceto acetyl modified polyvinyl alcohol is available, e.g. Gohsefimer Z series of polyvinyl alcohols from Nippon Gohsei (Japan).

Crosslinking of the reactive keto groups can be achieved by several substances having reactive groups like diamines, e.g. hexamethylenediamine or m-xylenediamine, dihydrazides, glyoxylic acid, salts of glyoxylic acid, dialdehydes, e.g. glyoxal, di- or polyols, e.g methylolmelamine or urea formaldehyde resins or urea glyoxal resins. Furthermore, crosslinking can be achieved by polyvalent metal salts, e.g. zirconates or titanates. Glyoxal, glyoxylic acid, salts of glyoxylic acid as sodium or calcium salts and adipic acid dihydrazide are specifically useful for crosslinking of the keto modified poly(vinyl alcohol).

Mixtures of polyvinyl alcohol and/or its derivatives in the formulation can be advantageous, e.g. for optimizing water sensitivity, viscosity, solubility and coating process parameters.

Typically, the weight average molecular weight of the polyvinyl alcohol or one of its derivatives is at least 100.000 g/mol, more preferably at least 120.000 g/mol, and most preferably at least 150.000 g/mol, as determined by gel permeation chromatography using polystyrene standards combined with static light scattering (absolute method) on re-acetylized specimen. Re-acetylization is performed by standard methods known in the art, e.g. in a pyridine/acetic anhydride mixture. There is no typical maximum value of the weight average molecular weight; sometimes it is below 300.000 g/mol.

According to the present invention, the ink-receiving layer (b) may comprise inorganic particles comprising aluminum oxide hydroxide, preferably boehmite, and a binder comprising polyvinyl alcohol. Alternatively, the ink-receiving layer (b) may comprise inorganic particles comprising silica, preferably fumed silica, and a binder comprising polyvinyl alcohol.

According to the present invention, the ink-receiving layer (b) may comprise the inorganic particles and the binder in a weight ration ranging of from 2:1 to 20:1, preferably from 3:1 to 15:1, more preferably from 7.5:1 to 14:1, and even more preferable from 8:1 to 12:1. The weight ratio of the inorganic particles and the binder may vary in dependency of which type of inorganic particle and which type of binder(s) are used. Boehmite particles and the binder, preferably polyvinyl alcohol, may be present in a weight ratio in the range of from 6.5:1 to 20:1, preferably 7:1 to 15:1. Silica particles and the binder, preferably polyvinyl alcohol, may be present in a weight ratio in a range of from 2:1 to 15:1, preferably from 3:1 to 10:1. A lower weight ratio might result in an ink-receiving layer having a too low porosity and thus low ink absorptivity, and a higher weight ratio might result in an ink receiving layer which exhibits a low adhesion to the adhesion promoting layer, and can cause dust particles when cut or when twisted or folded.

The total amount of inorganic particles and binder in the ink-receiving layer (b) may range from 79 to 99.9 wt.-%, preferably 90 to 99.5 wt.-%, based on the total dry coating weight of the ink-receiving layer.

The ink-receiving layer (b) of the present invention may comprise further particles in addition to the inorganic particles described above, e.g. in order to adapt the coefficient of friction (CoF) and the gloss of the surface of the inkjet printable twist and/or fold wrap film. Suitable particles preferably have a particle size ($d_{50}$, volume mean) of 1 to 25 μm, as determined by laser diffraction according to ISO 13320:2020, and include silicas such as precipitated silicas, fumed silicas, gel type silicas, colloidal silicas, preferably gel type silicas, and polymeric particles such as dispersible particles comprising a polymer selected from polymers and copolymers of ethylene, propylene, styrene, tetrafluoroethylene, and (meth)acrylates, e.g. polymethylmethyacrylate and styrene/methylmethacrylate copolymer; polyamides; polyesters; and starch, such as rice or corn starch, and mixtures of the afore-mentioned particles. Preferably, the further particles include the above-mentioned silicas and polymeric particles, are spherical.

The optional particles which are different from the inorganic particles, such as boehmite, are comprised in the ink-receiving layer in a maximum amount of 20 wt.-%, based on the total dry coating weight of the ink-receiving layer, preferably the ink-receiving layer comprises >0 to 5 wt.-% of these optional particles. More specifically, the ink-receiving layer can comprise >0 to 12 wt.-% of silica as described above and/or >0 to 10 wt.-% of polymeric particles as described above, such as >0 to 5 wt.-% of silica as the optional particles and/or >0 to 5 wt.-% of polymeric particles as the optional particles, based on the total dry coating weight of the ink-receiving layer.

According to the present invention, the ink-receiving layer (b) may comprise a crosslinking agent. The crosslinking agent may comprise boric acid, borate, dialdehydes such as glyoxal, glyoxylic acid, salts of glyoxylic acid such as sodium or calcium salts, dihydrazides such as adipic acid dihydrazide, di- or polyols such as methylolmelamine, urea glyoxyl resin or urea glyoxal resins, polyvalent metal salts such as zirconates or titanates, compounds having silanol groups or combinations thereof, preferably boric acid, borate, dialdehydes such as glyoxal, glyoxylic acid, salts of glyoxylic acid such as sodium or calcium salts, dihydrazides such as adipic acid dihydrazide, di- or polyols such as methylolmelamine, urea glyoxyl resin or urea glyoxal resins, compounds having silanol groups or combinations thereof.

Preferably, the ink-receiving layer (b) comprises inorganic particles, a binder comprising polyvinyl alcohol and a crosslinking agent comprising boric acid, borate, glyoxal, glyoxylic acid, salts of glyoxylic acid, dihydrazides such as adipic acid dihydrazide, urea glyoxyl resin, compounds having silanol groups or combinations thereof, preferably boric acid and/or borate. The boric acid can be added as boric acid, boron oxide (reacting with water to boric acid) or borate such as sodium tetraborate decahydrate and potassium tetraborate decahydrate. Boric acid and/or borates are typically used in a total amount of from >0 to 20 wt.-%, preferably from 1 to 15 wt.-%, and more preferably from 3 to 12 wt.-%, each calculated as $H_3BO_3$ and based on the amount of poly(vinyl alcohol). The boric acid crosslinking agent may improve the drying properties of the ink-receiving layer, e.g. avoids crack formation in the coating during the drying process. If high amounts of boric acid/borate are used strong crosslinking of the polyvinyl alcohol results which might lead to a brittle coating at high coating weights. Other crosslinking agents as described above may be added to the ink-receiving layer or replace the boron containing component.

According to the present invention, the ink-receiving layer (b) may further comprise a dispersing agent, preferably an acidic dispersing agent. Preferably, the ink-receiving layer (b) comprises inorganic particles comprising boehmite, a binder, and a dispersing agent, preferably an acidic dispersing agent.

For boehmite particles, acidic dispersing agents with $pk_a$ value of less than 5.0, preferably less than 4.5, more preferably less than 4.0, even more preferably less than 3.0, and most preferably less than 2.0 may be used.

Suitable acidic dispersing agents include strong monobasic organic acids having a $pk_a$ of less than 5.0, such as formic acid ($pk_a$=3.77), acetic acid ($pk_a$=4.75), lactic acid ($pk_a$=3.90), and propionic acid ($pk_a$=4.87), and inorganic acids having a $pk_a$ of less than 5.0. In preferred embodiments the acidic dispersing agent comprises an inorganic acid having a $pk_a$ of less than 2.0, such as HCl, HBr, $HNO_3$, and sulfamic acid.

Preferably, the acidic dispersing agent, especially the preferred acidic dispersing agents mentioned above, is present in a maximum amount of 10 wt.-%, based on the weight of the inorganic particles, such as the boehmite particles. Typical amounts of the acidic dispersing agent range from 1 to 5 wt.-%, based on the weight of the inorganic particles, such as the boehmite particles.

In case of non-surface modified fumed silica particles, prior to a fine dispersion of these anionic particles a cationic modification of the surface has to be achieved by cationic polymers, cationic oligomers, amino silanes or inorganic multivalent cations like aluminum or titanium salts. Suitable examples for cationic polymers with cationic charge are poly amino(meth)acrylates and copolymers, PDADMAC and copolymers, cationic modified polystyrenes, cationic polyurethanes. Inorganic modification of the silica surface can also be achieved. These substances and their mixtures can be used for dispersion of the fine silica particle in order to achieve a dispersion of small primary aggregates of silica particles typically having a particle size ($d_{50}$, volume mean) in the range of from 30 to 300 nm, preferably from 50 to 200 nm, more preferably from 80 to 180 nm.

The ink-receiving layer (b) comprising inorganic particles comprising silica may comprise cationic aluminum salts, e.g. polyaluminiumchlorid, polyaluminiumoxychlorid, cationic silanes or their corresponding hydrolysates, e.g. 3-aminopropyl trimethoxysilane, N-2-aminoethyl-3-aminopropyl trimethoxysilane, n-butyl aminopropyl trimethoxysilane, aminopropyl triethoxysilane, N-2-aminoethyl-3-aminopropyl triethoxysilane, n-butyl aminopropyl triethoxysilane, poly(diallyldimethylammonium chloride) (polyDADMAC) and/or cationic poly(meth)acrylates in order to render the silica pigments dispersible.

Further optional components apart from the acidic dispersing agent and crosslinking agent may be present in the ink-receiving layer(s) (b). These optional components include compounds such as adhesion promoting agents such as polymeric dispersions, wetting agents, antifoaming agents, surfactants, biocides, plasticizing agents, hydrophobic modification agents, stabilizers, silanes, colorants, fixing agents, antistatic agents, dyes, UV absorbers and optical brighteners. Typically, the ink-receiving layer preferably comprises less than 10 wt.-%, preferably less than 5 wt.-%, more preferably less than 3 wt.-%, based on the total weight of the ink-receiving layer of such optional compounds.

The ink-receiving layer (b) has a dry coating weight in the range of from 8 to 30 $g/m^2$, preferably from 10 to 27 $g/m^2$, more preferably from 10 to 25 $g/m^2$, even more preferably from 12 to 25 $g/m^2$, most preferably from 14 to 25 $g/m^2$. The ink-receiving layer (b) has a dry coating weight of at least 8 $g/m^2$, such as at least 10 $g/m^2$, at least 12 $g/m^2$, at least 14 $g/m^2$, at least 16 $g/m^2$, or at least 18 $g/m^2$. The ink-receiving layer (b) has a dry coating weight of 30 $g/m^2$ or less, such as 27 $g/m^2$ or less, 25 $g/m^2$ or less, or 22 $g/m^2$ or less. A person skilled in the art will appreciate that any range between the explicitly disclosed lower and upper limit is herein disclosed. The above-mentioned dry coating weight provides for an ink-receiving layer having a high crack resistance necessary for the use as a twist and/or fold wrap, while providing good printing quality.

According to the present invention, the inkjet printable twist and/or fold wrap film comprises an adhesion promoting layer (c) between the non-oriented polymer film (a) and the at least one ink-receiving layer (b). The adhesion promoting layer (c) ensures good coating adhesion of the microporous ink-receiving layer (b) as well as good film properties, while the ink-receiving layer (b) does not exhibit brittleness, which is necessary for the use as twist and/or fold wrap films.

The adhesion promoting layer (c) may comprise (co) polyester; polyvinylidene chloride; vinylchloride vinylacetate copolymer; (meth)acrylic (co)polymer; nitrocellulose; ethylene acrylic acid copolymer; or copolymers or combinations thereof, preferably (co)polyester, more preferably biodegradable (co)polyester. As used herein, the term "biodegradable" refers to polyester which break down under compost conditions over a verifiable period of time such as 6 months into organic components including, e.g., carbon dioxide and water. According to the invention the (co) polyester may comprise polyhydroxyalkanoates such as poly(3-hydroxypropionate), poly(3-hydroxybutyrate), poly (3-hydroxyvalerate) or (poly(3-hydroxybutyrate-co-3-hydroxyvalerate); polybutylene succinate; polylactic acid; aliphatic-aromatic co-polyester such as poly(ethylene glutarate-co-terephthalate), poly(tetramethylene glutarate-co-terephthalate), poly(tetramethylene glutarate-co-terephthalate-co-diglycolate), poly(ethylene adipate-co-terephthalate), poly(tetramethylene succinate-co-terephthalate), poly (ethylene glutarate-co-naphthalene dicarboxylate), poly (tetramethylene glutarate-co-naphthalene dicarboxylate), poly(tetramethylene adipate-co-naphthalene dicarboxylate), poly(ethylene adipate-co-naphthalene dicarboxylate), poly (tetramethylene succinate-co-naphthalene dicarboxylate), or poly(ethylene succinate-co-naphthalene dicarboxylate); polyethylene 2,5-furandicarboxylate; or copolymers or combinations thereof. According to the invention biodegradable (co)polyester may comprise polyhydroxyalkanoates such as poly(3-hydroxypropionate), poly(3-hydroxybutyrate), poly (3-hydroxyvalerate) or (poly(3-hydroxybutyrate-co-3-hydroxyvalerate); polybutylene succinate; polylactic acid; an aliphatic-aromatic co-polyester such as poly(ethylene glutarate-co-terephthalate), poly(tetramethylene glutarate-co-terephthalate), poly(tetramethylene glutarate-co-terephthalate-co-diglycolate), poly(ethylene adipate-co-terephthalate), poly(tetramethylene succinate-co-terephthalate), poly(ethylene glutarate-co-naphthalene dicarboxylate), poly(tetramethylene glutarate-co-naphthalene dicarboxylate), poly(tetramethylene adipate-co-naphthalene dicarboxylate), poly(ethylene adipate-co-naphthalene dicarboxylate), poly(tetramethylene succinate-co-naphthalene dicarboxylate), or poly(ethylene succinate-co-naphthalene dicarboxylate); or copolymers or combinations thereof. Suitable examples of (co)polyesters, in particular biodegradable (co)polyesters, include EASTAR BIO copolyester poly(tetramethylene adipate-co-terephthalate) polymer available from Eastman Chemical Company (USA), BioPBS™ commercially available from Mitsubishi Chemical Corporation (Japan), MATER-BI bioplastics commercially available from Novamont (Italy), and Mitsubishi AZ91T commercially available from Mitsubishi Chemical Corporation (Japan).

The adhesion promoting layer (c) may have a dry coating weight of less than 12 g/m$^2$, preferably less than 10 g/m$^2$, more preferably less than 8 g/m$^2$, even more preferably less than 6 g/m$^2$, most preferably less than 5 g/m$^2$. The adhesion promoting layer (c) may have a dry coating weight of at least 0.5 g/m$^2$, preferably of at least 1.0 g/m$^2$, more preferably of at least 1.5 g/m$^2$, even more preferably of at least 2.5 g/m$^2$. A person skilled in the art will appreciate that any range between the explicitly disclosed lower and upper limit is herein disclosed. The adhesion promoting layer (c) may have a dry coating weight in the range of from 0.5 to 12 g/m$^2$, preferably from 1.0 to 8 g/m$^2$, more preferably from 2.0 to 5 g/m$^2$.

According to the present invention, the adhesion promoting layer (c) may have a thickness of 20 μm or less, preferably 15 μm or less, more preferably 10 μm or less, even more preferably 8 μm or less, most preferably 7 μm or less or 5 μm or less. The adhesion promoting layer (c) may have a thickness of 0.5 μm or more, preferably 1.0 μm or more, more preferably 2.0 μm or more. A person skilled in the art will appreciate that any range between the explicitly disclosed lower and upper limit is herein disclosed. The adhesion promoting layer (c) may have a thickness in the range of from 0.5 to 20 μm, preferably from 1.0 to 10 μm, more preferably from 2.0 to 5 μm.

According to the present invention, the adhesion promoting layer (c) may have barrier properties, such as moisture and/or gas barrier properties such as oxygen barrier properties, preferably moisture barrier properties. As used herein, the term "moisture barrier" refers to the property of a material to prevent or reduce the permeability of water vapor and the term "gas barrier" or the term "oxygen barrier" refers to the property of a material to prevent or reduce the permeability of a gas, such as oxygen. The adhesion promoting layer (c) having barrier properties may comprise (co)polyester and at least one of polyvinylidene chloride, polylactic acid, polyvinyl alcohol and polyvinyl alcohol derivatives; preferably (co)polyester and polyvinylidene chloride, more preferably biodegradable (co)polyester and polyvinylidene chloride.

An additional layer may be positioned over the surface of the non-oriented polymer film (a) opposite to the surface over which the ink-receiving layer (b) is formed. The additional layer may be a layer as defined for the adhesion promoting layer (c). The Ink-receiving layer (b) may only be positioned on one surface of the non-oriented polymer film (a).

The inkjet printable twist and/or fold wrap film of the present invention may further comprise a barrier layer positioned between the non-oriented polymer film (a) and the ink-receiving layer (b), preferably between the non-oriented polymer film (a) and the adhesion promoting layer (c) and/or over the surface of the non-oriented polymer film (a) opposite to the surface over which the ink-receiving layer (b) is formed. The barrier layer may comprise a metal or metal oxide layer.

Suitable metal oxides to be used as barrier layer include siliconoxide (SiOx) and aluminumoxide (AlOx). Metallization and metal oxide coating is usually performed by physical vapor deposition and accordingly, the thickness of the metal or metal oxide layer is typically from 10 to 150 nm. The barrier layer can also be a polymer film having barrier properties such as a polymer film comprising polyvinylidene chloride, polylactic acid, polyvinyl alcohol, polyvinyl alcohol derivatives or ethylene vinyl alcohol copolymers.

According to the present invention, the barrier layer may be a moisture barrier layer and/or oxygen barrier layer. In order to have significant barrier properties such as moisture barrier properties and/or gas such as oxygen barrier properties, the barrier layer may be positioned between the non-oriented polymer film (a) and the adhesion promoting layer (c).

The inkjet printable twist and/or fold wrap film of the present invention may have a permeability to water vapor of 300 g/m$^2$ or less, preferably of 280 g/m$^2$ or less, more preferably 250 g/m$^2$ or less, even more preferably 220 g/m$^2$ or less, most preferably 200 g/m$^2$ or less, determined according to ASTM E96-16 (per 24 h at 38° C. and 90% RH). The inkjet printable twist and/or fold wrap film of the present invention may have a permeability to water vapor in the range of 3 to 300 g/m$^2$, preferably 3 to 200 g/m$^2$, more preferably 5 to 200 g/m$^2$, determined according to ASTM E96-16 (per 24 h at 38° C. and 90% RH).

The inkjet printable twist and/or fold wrap film of the present invention may have a permeability to oxygen of 15 mL/m$^2$ or less, preferably 12 mL/m$^2$ or less, even more preferably 10 mL/m$^2$ or less, determined according to ASTM F 1927-20 (per 24 h at 23° C. and 50% RH). The inkjet printable twist and/or fold wrap film of the present invention may have a permeability to oxygen in the range of from 1 to 15 mL/m$^2$, preferably from 1 to 10 mL/m$^2$, more preferably from 2 to 10 mL/m$^2$, determined according to ASTM F 1927-20 (per 24 h at 23° C. and 50% RH).

According to the present invention, the inkjet printable twist and/or fold wrap film may further comprise a primer layer. The primer layer of the present invention may be positioned between the non-oriented polymer film (a) and the adhesion promoting layer (c) and/or over the surface of the non-oriented polymer film (a) opposite to the surface over which the ink-receiving layer (b) is formed. If the inkjet printable twist and/or fold wrap film comprises a barrier layer, the primer layer may be positioned between the non-oriented polymer film (a) and the barrier layer.

The primer layer may comprise a (co)polyester. The (co)polyester may comprise polyhydroxyalkanoates; polybutylene succinate; polylactic acid; an aliphatic-aromatic co-polyester; polyethylene 2,5-furandicarboxylate; or combinations thereof. According to the invention, the primer layer may be applied by means of a solvent or water-based coating process. The thickness of the primer layer can range from 0.1 to 3.0 μm, such as from 0.1 to 2.7 μm, or from 0.5 to 2.7 μm, or from 0.5 to 2.5 μm.

According to the present invention, the inkjet printable twist and/or fold wrap film may further comprise a sealing layer. The sealing layer of the present invention may be positioned over the surface of the non-oriented polymer film (a) opposite to the surface over which the ink-receiving layer (b) is formed. If the inkjet printable twist and/or fold wrap film comprises a barrier layer and/or a primer layer, the barrier and/or primer layer may be positioned between the non-oriented polymer film (a) and the sealing layer.

The sealing layer can be a heat-sealing layer, a layer for ultrasonic sealing, a layer for solvent sealing and a pressure-sealing layer. The thickness of the sealing layer can range from 0.5 to 5 μm, such as from 0.5 to 4.5 μm, or from 0.8 to 4.0 μm. Preferably the sealing layer is a heat-sealing layer.

Suitable materials for the heat-sealing layer are polymeric materials having a heat seal temperature of from 70 to 200° C. Suitable materials for the heat-sealing layer include polyethylene such as polypropylene (PP), low density polyethylene (LDPE), linear low density polyethylene (LLDPE), polyethylene copolymers, e.g. with acrylic acid, polypropylene (co)polymers, amorphous poly(ethylene terephthalate) (APET), not biaxially oriented glycol-modified poly (ethylene terephthalate) (PET-G), not biaxially oriented polyamide (PA), and not biaxially oriented polylactide (PLA), poly(vinylidene fluoride), poly(vinyl acetate), poly (meth)acrylates, and (co)polyesters, preferably (co)polyesters. Exemplary heat-sealing lacquers include polymer dispersions and emulsions (such as modified ethylene/acrylic acid copolymer (e.g. TECSEAL® available from Trüb Chemie) as well as solvent (e.g. poly(vinylidene chloride) and vinylacetate copolymers) or hot melt based or extrusion based materials. The preferred thickness of the heat-sealing layer is within the range from 0.5 to 5 μm, such as from 0.5 to 4.5 μm, or from 0.8 to 4.0 μm.

According to the present invention, the sealing layer may have barrier properties, such as moisture and/or gas barrier properties such as oxygen barrier properties, preferably moisture barrier properties. The sealing layer having barrier properties may comprise polyvinylidene chloride, polylactic acid, polyvinyl alcohol, polyvinyl alcohol derivatives and combinations thereof. Preferably, the sealing layer having barrier properties may comprise (co)polyester and at least one polymer selected from the group of polyvinylidene chloride, polylactic acid, polyvinyl alcohol and polyvinyl alcohol derivatives.

It is understood that the mention of the optional layers/films of the inventive inkjet printable twist and/or fold wrap film is not exhaustive, i.e. further layers/films not specifically described herein may be present.

It is understood that the above-mentioned additional layers can be present in any feasible combination and sequence with the proviso that the ink-receiving layer (b) and sealing layer are outer layers. Moreover, the inkjet printable twist and/or fold wrap film of the present invention may comprise further layers which are not specifically discussed herein.

Non-limiting exemplary sequences of layers of the inventive inkjet printable twist and/or fold wrap film include:

--- ink-receiving layer (b)
adhesion promoting layer (c)
non-oriented polymer film (a)
ink-receiving layer (b)
adhesion promoting layer (c)
non-oriented polymer film (a)
barrier layer
ink-receiving layer (b)
adhesion promoting layer (c) having barrier properties
non-oriented polymer film (a)
barrier layer
ink-receiving layer (b)
adhesion promoting layer (c)
non-oriented polymer film (a)
sealing layer
ink-receiving layer (b)
adhesion promoting layer (c) having barrier properties
non-oriented polymer film (a)
sealing layer
ink-receiving layer (b)
adhesion promoting layer (c)
non-oriented polymer film (a)
barrier layer
sealing layer
ink-receiving layer (b)
adhesion promoting layer (c)
barrier layer
primer layer
non-oriented polymer film (a)
primer layer
sealing layer
ink-receiving layer (b)
adhesion promoting layer (c)
barrier layer
primer layer
non-oriented polymer film (a)
primer layer
barrier layer -continued

| |
|---|
| sealing layer |
| ink-receiving layer (b) |
| adhesion promoting layer (c) |
| primer layer |
| non-oriented polymer film (a) |
| primer layer |
| sealing layer |
| ink-receiving layer (b) |
| adhesion promoting layer (c) |
| primer layer |
| non-oriented polymer film (a) |
| barrier layer |
| sealing layer |
| ink-receiving layer (b) |
| adhesion promoting layer (c) |
| primer layer |
| non-oriented polymer film (a) |
| primer layer |
| barrier layer |
| sealing layer |
| ink-receiving layer (b) |
| adhesion promoting layer(c) having barrier properties |
| non-oriented polymer film (a) |
| sealing layer having barrier properties |

The inkjet printable twist and/or fold wrap film of the present invention may have a total thickness of from 20 to 100 μm, preferably from 20 to 90 μm, more preferably from 20 to 80 μm, even more preferably from 23 to 80 μm. The grammage of the inkjet printable twist and/or fold wrap film preferably ranges from 13 to 100 g/m$^2$, more preferably from 26 to 80 g/m$^2$. The thickness and the grammage of the inkjet printable twist and/or fold wrap film can be determined according to ISO 534 and ISO 536, respectively.

According to the present invention, the inkjet printable twist and/or fold wrap film may comprise up to 50 wt.-% of the ink-receiving layer (b), such as of up to 48 wt.-%, or of up to 45 wt.-%, or of up to 40 wt.-%, or of up to 38 wt.-%, based on the total weight of the inkjet printable twist and/or fold wrap film. The inkjet printable twist and/or fold wrap film may comprise at least 15 wt.-% of the ink-receiving layer (b), such as at least 18 wt.-%, or at least 20 wt.-%, or at least 22 wt.-%, or at least 25 wt.-%, or at least 27 wt.-%, based on the total weight of the inkjet printable twist and/or fold wrap film. A person skilled in the art will appreciate that any range between the explicitly disclosed lower and upper limit is herein disclosed. The inkjet printable twist and/or fold wrap film may comprise 15 to 50 wt.-% of the ink-receiving layer (b), preferably 20 to 50 wt.-%, more preferably 20 to 45 wt.-%, based on the total weight of the inkjet printable twist and/or fold wrap film.

According to the present invention, the inkjet printable twist and/or fold wrap film may have a twist retention of more than 350°. As used herein, the term "twist retention" refers to the measure of the film's ability to retain a twist. Herein, the twist retention represents the difference of rotation angle (540°) and the change of the twist angle after 30 seconds. The twist retention can be determined as further described in the examples below.

According to the present invention, the inkjet printable twist and/or fold wrap film may have a dead fold retention of at least 100°, preferably of at least 140°. As used herein, the term "dead fold retention" refers to the measure of the film's ability to retain a fold or crease. Herein, the dead fold retention represents the retained angle (180° minus the opening angle). The dead fold retention can be determined as further described in the examples below.

The inkjet printable twist and/or fold wrap film of the present invention may be industrially compostable and/or home compostable. Preferably the inkjet printable twist and/or fold wrap film of the present invention is industrially compostable. Industrial compostability may be determined according to EN 13432:2000. Home compostability may be determined according to AS 5810-2010.

The surface of the inkjet printable twist and/or fold wrap film opposite to the surface over which the ink-receiving layer is formed may exhibit a coefficient of friction (CoF) to itself of 0.45 or less, such as in the range of from 0.15 to 0.45. The coefficient of friction is determined according to EN ISO 8295:2004 with a 200 g weight at 100 mm/min drawing speed.

The present invention further relates to a method for preparing the inkjet printable twist and/or fold wrap film as described above comprising the steps:

(a) providing a non-oriented polymer film being a regenerated cellulose film;

(b) applying an adhesion promoting layer over at least a part of one surface of the non-oriented film (a);

(c) coating the surface of the non-oriented polymer film comprising the adhesion promoting layer (b) with a ink-receiving layer composition comprising inorganic particles and a binder at a dry coating weight being in the range of 8 to 30 g/m$^2$.

According to the present invention, the adhesion promoting layer may be applied by means of hot melt or extrusion coating, preferably extrusion coating. The adhesion promoting layer may be supplied in molten form from an extruder to a hot melt coating unit comprising a melt pump feeding a die, through which the molten coating is extruded onto the non-oriented polymer film. The coating may be extruded through a curtain die onto the non-oriented polymer film and drawn through a pair of counter-rotating rollers. The curtain die may include any shape, configuration and/or number of die slots or holes which give rise to a continuous falling curtain of material exiting the die.

The ink-receiving layer composition may be an aqueous composition. In order to prepare the ink-receiving layer composition for forming the ink receiving layer of the inkjet printable twist and/or fold wrap film of the present invention, the components are typically mixed by conventional lacquer manufacturing means. Preferably, the inorganic particles as described above, preferably boehmite or silica particles are dispersed in cold or hot water by means of strong agitation or high shear mixing devices, e.g. with rotor-stator principle. The ink-receiving layer composition may further comprise a dispersing agent as described above. Dispersing the inorganic particles in cold or hot water by means of strong agitation or high shear mixing devices is preferably performed in the presence of the dispersing agent. This leads to a dispersion with the required particle size for a homogeneous coating. Typically, the binder as described above, preferably poly(vinyl alcohol) is separately dissolved in water and heated for full dissolution to temperatures of from 70° C. to 100° C. The particle dispersion and binder solution may be mixed together in order to obtain an aqueous coating composition. The ink-receiving layer composition may further comprise a crosslinking agent as described above. Crosslinking agents, such as boric acid/boron oxide/borates, and any other optional ingredients can be added at any stage of the preparation process. Boric acid/boron oxide/borates are added preferably shortly before applying the aqueous coating composition to the substrate. Alternatively or additionally, boric acid/boron oxide/borates can also be applied to the substrate before application of the aqueous coating composition.

Typically, the ink-receiving layer composition, preferably being an aqueous composition, has a solid content of from 10 to 40 wt.-%, preferably from 20 to 35 wt.-%. A typical pH value is within the range of from 2 to 6, preferably from 3 to 5.

The ink-receiving layer composition can be coated onto the substrate, i.e. the non-oriented polymer film, by any conventional coating method known in the art. For example, the ink-receiving layer composition can be applied by means of a curtain coater, a die coater, a roll coater, an air knife coater, a knife coater, a blade coater, a rod coater, a bar coater, or a comma coater. Application by a curtain coater, such as a curtain coater having one or multiple dies, is preferred. The ink-receiving layer composition is applied on the surface of the non-oriented polymer film such that the adhesion promoting layer is between the non-oriented film and the ink-receiving layer.

The method for preparing the inkjet printable twist and/or fold wrap film as described above may further comprise applying a barrier layer between the non-oriented polymer film and the ink-receiving layer, preferably between the non-oriented polymer film and the adhesion promoting layer (c); and/or over the surface of the non-oriented polymer film opposite to the surface over which the ink-receiving layer is formed. For instance, the barrier layer may be included by metallizing the respective surface by, e.g., physical or chemical vapor deposition (PVD, CVD).

The method for preparing the inkjet printable twist and/or fold wrap film as described above may further comprise applying a primer layer between the non-oriented polymer film (a) and the adhesion promoting layer (c) and/or over the surface of the non-oriented polymer film (a) opposite to the surface over which the ink-receiving layer (b) is formed. If the inkjet printable twist and/or fold wrap film comprises a barrier layer, the primer layer may be positioned between the non-oriented polymer film (a) and the barrier layer. The primer layer may be applied by means of a solvent or water-based coating process, preferably of a solvent or water-based coating composition comprising (co)polyesters.

The method for preparing the inkjet printable twist and/or fold wrap film as described above may further comprise applying a sealing layer to the surface of the non-oriented polymer film opposite to the surface over which the ink-receiving layer is formed. The sealing layer and/or the barrier layer can be applied by any known coating processes using conventional aqueous water-based or solvent-based and solvent-free coating systems. If the inkjet printable twist and/or fold wrap film comprises a barrier layer and/or a primer layer, the barrier and/or primer layer may be positioned between the non-oriented polymer film (a) and the sealing layer.

The present invention further relates to an inkjet printed twist and/or fold wrap film for packaging applications. The inkjet printed twist and/or fold wrap film is obtained by printing the inkjet-receiving layer (b) of the inkjet printable twist and/or fold wrap film as described above and further applying an overprint varnish layer (d) as an outer layer over the printed ink-receiving layer (b).

The inkjet-receiving layer (b) of the inkjet printable twist and/or fold wrap film of the present invention may be printed by means of inkjet printing. Advantageously, the inventive inkjet printable twist and/or fold wrap film is printed with a digital inkjet printer running with high printing speed such printing speeds from 3 to 300 m/min, preferably comprising a single pass printing system, i.e. a printing system comprising a stationary printing bar over the web width which bar comprises the printing heads. Exemplary high speed single pass inkjet digital presses are commercially available from Hewlett Packard (PageWide Industrial Presses), Kodak (Prosper®, Versamark®), Canon (Océ VarioPrint), KBA (RotaJet®), Palis (Padaluma Printing), AstroNova/Trojan, Afinia, and Rigoli. High speed single pass inkjet printers are typically operated with piezo printing heads, for example available from Fujifilm Dimatix (e.g. SAMBA® printing head), Kyocera, Ricoh, and Xaar, with continuous ink jet print heads, e.g. from Kodak, or with printing heads and printing bars, respectively, available from Memjet or Canon.

Preferably, the inkjet-receiving layer (b) of the inkjet printable twist and/or fold wrap film of the present invention is printed using water-based inks, preferably water-based pigmented inks. Any aqueous (water-based) inkjet ink can be used for printing on the ink-receiving layer (b). Suitable aqueous inks include both dye-based inks comprising water-soluble dyes and/or dye clusters and pigment-based comprising dispersed pigment, wherein pigment-based inks are preferred. The inks may contain substances such as surfactants, dispersing agents, humectants, binders, biocides, defoamers, polymers and the like.

Suitably, a four ink CMYK (cyan, magenta, yellow, and black) system can be used for printing on the ink-receiving layer (b) of the inkjet printable twist and/or fold wrap film. However, special colors, e.g. blue, green, orange, red and particularly white or silver, may be used as well. Typical pigment preparations are, e.g., offered by Clamant under the Hostajet® PT brand, e.g. Hostajet® Yellow 4G-PT (PIGMENT YELLOW 155), Hostajet® Red D3G-PT VP 5121 (PIGMENT RED 254), Hostajet® Magenta E5B-PT (PIGMENT VIOLET 19), Hostajet® Magenta E-PT (PIGMENT RED 122), Hostajet® Cyan BG-PT (PIGMENT BLUE 15:3), Hostajet® Green 8G-PT VP 5154 (PIGMENT GREEN 36), Hostajet® Black O-PT (PIGMENT BLACK 7).

Preferably, aqueous pigment-based inks comprising low amounts of polymeric dispersing agents and polymeric binders are useful. The ink may contain humectants. Suitable humectants include polyols, e.g. ethylene glycol, diethylene glycol, 1,2-propanediol, 1,3-propanediol, 1,2-butanediol, 1,3-butanediol, 1,4-butanediol, 2,3-butanediol, 3-methyl-1,3-butane diol, triethylene glycol, polyethylene glycol, polypropylene glycol, pentanediols, hexanediols, glycerin, 1,2,6-hexanetriol, 2-ethyl-1,3-hexanediol, ethyl-1,2,4-butanetriol, 1,2,3-butanediol, 2,2,4-trimethyl-1,3-pentanediol, polyol alkylethers such as ethylene glycol monoethylether, ethylene glycol monobutylether, diethylene glycol monomethylether, diethylene glycol monoethylether, diethylene glycol monobutylether, tetraethylene glycol monomethylether, propylene glycol monoethylether; polyol arylethers, 2-pyrolidone, N-methyl-2-pyrolidone, N-hydroxyethyl-2-pyrolidone, 1,3-dimethyl-2-imidazolidinone, and E-caprolactam, N-methylformamide, N,N-dimethylformamide, 3-methoxy-N,N-dimethyl propionamide, monoethanolamine, diethanolamine, triethylamine, dimethyl sulfoxide, sulfolane, propylene carbonate, ethylene carbonate or combinations thereof.

According to the present invention, an overprint varnish layer is applied as an outer layer over the printed ink-receiving layer (b). The overprint varnish may be applied on at least a part of the printed ink-receiving layer (b), preferably the printed part of the printed ink-receiving layer of the inkjet printable twist and/or fold wrap film of the present invention. The overprint varnish preferably is applied as an all-over varnish, i.e. on the whole surface of the inkjet printable twist and/or fold wrap film comprising the ink-receiving layer (b), which is printed. The overprint varnish provides an improved rub resistance as well as soiling resistance without impairing the print quality.

According to the present invention, the overprint varnish may be an aqueous or solvent based composition, preferably aqueous based composition. The overprint varnish may comprise, polyepoxides, polyurethanes, polyesters, (meth) acrylic polymers, copolymers and combinations thereof. Examples of acrylic (co)polymers may include styrene acrylic polymers, butyl methacrylate polymers, ethyl methacrylate polymers, iso-butyl methacrylate polymers, methyl methacrylate polymers, or combinations thereof.

The overprint varnish may be formed from UV curable oligomers such as epoxies, urethanes, polyesters, (meth) acrylates, and combinations thereof. These oligomers are cured by free-radicals generated by photoinitiators after exposure to UV light. Reactive diluents such as hexanediol diacrylate, pentaerythritol tetraacrylate, N-vinylpyrrolidinone, and the like, can be used to control viscosity of the composition before cure and to modify the crosslink density.

Suitable examples of overprint varnishes include DigiGuard® IJ overprint varnishes, such as DigiGuard® IJ 520, DigiGuard® IJ 630, DigiGuard® LT 632 and DigiGuard® IJ 634 commercially available from Michelman (USA), DigiGuard® Gloss overprint varnishes, such as DigiGuard® Gloss 310 and DigiGuard® Gloss 110 commercially available from Michelman (USA), ThermaGloss® overprint varnishes, such as ThermaGloss® 463, ThermaGloss® 425FLT and ThermaGloss® 460 commercially available from Michelman (USA) or ACTDigi products from Actega, e.g. ACTDigi® SCUFF RESISTANT AQ OPV WVG011938 commercially available from Actega GmbH (Germany).

The overprint varnish may also contain one or more additives to help improve manufacturability, storage or use of the inkjet printed twist and/or fold wrap film. Examples of additives include lubricants, wetting agents, leveling agents, waxes, slip aids, light stabilizers, antistatic agents, fungicides, bactericides, antioxidants, dispersants, flow control agents, antifoaming agents, or combinations thereof.

The overprint varnish may protect the ink-receiving layer (b) by providing one or more of increased chemical resistance, rub resistance, scratch resistance, and heat resistance, and thus improve the durability of the printed image. The overprint varnish may also improve the gloss of the printed film.

The overprint varnish layer (d) may have a thickness of at least 0.5 μm, such as of at least 0.8 μm, or of at least 1.0 μm. The overprint varnish layer (d) may have a thickness of 5.0 μm or less, such as of 4.5 μm or less, or of 4.0 μm or less, or of 3.5 μm or less, or of 3.0 μm or less. A person skilled in the art will appreciate that any range between the explicitly disclosed lower and upper limit is herein disclosed. Accordingly, the overprint varnish layer (d) may have a thickness in the range of from 0.5 to 5.0 μm, preferably from 0.8 to 3.0 μm.

According to the present invention, the inkjet printed twist and/or fold wrap film may further comprise a sealing layer. The sealing layer of the present invention may be positioned over the surface of the non-oriented polymer film (a) opposite to the surface over which the ink-receiving layer (b) is formed. The sealing layer may be as described above.

According to the present invention, the inkjet printed twist and/or fold wrap film may have a twist retention of more than 350°. Herein, the twist retention angle represents the difference of rotation angle (540°) and the change of the twist angle after 30 seconds. The twist retention can be determined as further described in the examples below.

According to the present invention, the inkjet printed twist and/or fold wrap film may have a dead fold retention of at least 100°, preferably of at least 140°. Herein, the dead fold retention represents the retained angle (180° minus the opening angle). The dead fold can be determined as further described in the examples below.

The inkjet printed twist and/or fold wrap film of the present invention may be industrially compostable and/or home compostable. Preferably the inkjet printed twist and/or fold wrap film of the present invention is industrially compostable. Industrial compostability may be determined according to EN 13432:2000. Home compostability may be determined according to AS 5810-2010.

According to the present invention, both surfaces of the inkjet printed twist and/or fold wrap film may exhibit a coefficient of friction (CoF) to itself of 0.45 or less, such as in the range of from 0.15 to 0.45. The coefficient of friction is determined according to EN ISO 8295:2004 with a 200 g weight at 100 mm/min drawing speed facing the ink-receiving layer to itself. Preferably, the surface of the inkjet printed twist and/or fold wrap film over which the ink-receiving layer is formed and further an overprint varnish is applied exhibits a coefficient of friction (CoF) to itself of 0.45 or less, such as in the range of from 0.15 to 0.45. The coefficient of friction is determined as described above. The CoF can be adjusted by adding slip additives and/or anti-block additives to the film or the overprint varnish such as waxes, stearates, fatty acid amides, silicones, talcum silica, silicone resin particles or combinations thereof.

The present invention further relates to a method for preparing the inkjet printed twist and/or fold wrap film as described above comprising the steps:

(a) providing the inkjet printable twist and/or fold wrap film of the present invention;
(b) printing of the ink-receiving layer of the inkjet printable twist and/or fold wrap film; and
(c) applying an overprint varnish as an outer layer over the printed ink-receiving layer.

The inkjet-receiving layer (b) of the inkjet printable twist and/or fold wrap film of the present invention may be printed by means of inkjet printing as described above. Preferably, the ink-receiving layer may be printed using water-based inks, more preferably water-based pigmented inks as described above.

According to the present invention, the overprint varnish may be applied by gravure printing or inkjet printing or by flexographic printing. The overprint varnish may be dried by convection drying (cold or heat assisted), IR drying or NIR drying or combinations thereof.

In the cases of a UV-curable varnish the overprint varnish may be cured immediately or after a certain period of time, such as in a time range of 5 to 60 sec. Curing of the overprint varnish may be performed by UV radiation, preferably using UV lamps, blue lasers, UV lasers or ultraviolet LEDs, hot air drying, IR or NIR drying or combinations thereof.

The present invention further relates to a packaging comprising the inkjet printable twist and/or fold wrap film as described above or the inkjet printed twist and/or fold wrap film as described above. The packaging of the present invention may comprise a packaging for food, pet food, beverages, pharmaceuticals and/or personal care products. Preferably, the packaging of the present invention comprises a packaging for food.

The present invention further relates to use of an inkjet printable twist and/or fold wrap film as described above or the inkjet printed twist and/or fold wrap film as described above for preparing a packaging for food, pet food, beverages, pharmaceuticals and/or personal care products, preferably for food. Additionally, the present invention relates to use of an inkjet printable twist and/or fold wrap film as described above or the inkjet printed twist and/or fold wrap film as described above or packaging food, pet food, beverages, pharmaceuticals and/or personal care products, preferably for packaging food.

Moreover, the present invention relates to a method of making a filled packaging comprising the steps of:

(i) providing the inkjet printed twist and/or fold wrap film as described above;

(ii) positioning goods onto the inkjet printed twist and/or fold wrap film;

(iii) wrapping the goods with the inkjet printed twist and/or wrap film and closing the wrapping by means of twisting or folding the inkjet printed twist and/or wrap film around the goods;

(iv) optionally partially sealing the packaging film.

As used herein, the term "goods" refers to any product, such as food, pet food, beverages, pharmaceuticals and/or personal care products.

According to the present invention, the inkjet printed twist and/or fold wrap film may be cut to a preferred size before positioning the goods onto the inkjet printed twist and/or fold wrap film. The inkjet printed twist and/or fold wrap film cuttings may be polygonal, round, oval, rectangular or square. Preferably, the goods may be positioned centrally onto the inkjet printed twist and/or fold wrap film. Typically, the goods are positioned onto the surface of the inkjet printed twist and/or fold wrap film opposite to the surface over which the ink-receiving layer is formed, printed and overprint varnish is applied.

The packaging film may be sealed at a temperature being in the range of from 70° to 200° C., preferably from 80 to 160° C.

EXAMPLES

Determining Twist Retention of Film Samples

The film sample is conditioned for 24 h in a standard climate of 23° C. and 50% relative humidity (RH) before starting the measurement, which is performed under the same conditions.

The apparatus for measuring twist retention is prepared as follows:

A steel laboratory rod with rounded ends and a diameter of 12 mm and a total length of 590 mm is fastened in a 90° twin-bored tunnel rectangular shaped metal block cross clamp with flat surfaces (Right Angle Clamp RA90 commercially available from Thorlabs GmbH (Germany)) in such a way that 3 cm of the rod protrudes from the cross clamp on one side. The total weight of rod and cross clamps is 7.90 kg.

The cross clamp with the fixed rod is positioned on top of a second metal block cross clamp with flat surfaces (Right Angle Clamp RA90 commercially available from Thorlabs GmbH (Germany)) with the shorter side of the rod passing vertically through one of the two tunnels of the (second) lower clamp so that the side of the rod protruding 3 cm from the (first) upper cross clamp faces upwards. The rod is not clamped in the (second) lower clamp so that the (first) upper clamp with the fixed rod can rotate freely.

The (second) lower clamp is fastened to a laboratory stand, with another laboratory rod passing through the second tunnel of the (second) lower clamp, in such way that the side of the rod protruding 3 cm from the (first) upper cross clamp faces upwards.

A spring clamp with flat jaws (25 mm wide×15 mm height) is positioned and fastened at a distance of 5 cm above the upper end of the rod protruding 3 cm from the (first) upper cross clamp with the axis of the rod centred below the centre of the jaws. The jaws of the spring clamp and the rod protruding 3 cm from the (first) upper cross clamp is positioned in a 90° angle.

The film is cut to a piece of 50 mm×65 mm. The narrow end of the strip (50 mm) is wrapped around the part of the rod protruding 3 cm from the (first) upper clamp so that the rod is completely surrounded by the film.

The film is first fastened using an adhesive tape (Tesafilm® 57370 commercially available from Tesa SE (Germany)) and additionally using a hose clamp.

The upper end of the film wrapped around the rod protruding 3 cm from the (first) upper clamp is pressed flat and 15 mm of the upper end of the film is clamped with the spring clamp jaws of the apparatus, so that the distance between the upper end of the rod protruding 3 cm from the (first) upper cross clamp and the lower end of the jaws is 20 mm.

The (first) upper cross clamp with the fastened rod is lifted off the (second) lower cross clamp by the spring clamp, leaving the shorter rod unclamped but vertically aligned in the vertical tunnel of the (second) lower cross clamp. A constant tensile load of 7.9 kg/77.5 N is applied to the film, which results from the weight of the (first) upper cross clamp and the rod fastened to it.

The exact alignment of the horizontal axis of the jaws is marked by a vertical line with a foil pen on the fastened part of the film surrounding the rod. This helps to control the rotation angle. The (first) upper cross clamp with the fastened steel rod is rotated by 540° (1½ turns) and the rotation is held for 15 seconds.

The jaws of the spring clamp are opened and the (first) upper cross clamp is re-positioned on the lower cross clamp. The resulting change in angle of the horizontal axis of the pressed flat film ending relative to the horizontal axis of the spring clamp jaws (indicated by the vertical foil pen line) is measured with a protractor after 30 seconds. The twist retention angle represents the difference of rotation angle (540°) and the change of the twist angle after 30 seconds.

A triplicate determination is performed for each sample and the mean value is determined. For curved or corrugated film ends, a straight line is assumed to pass through the two ends of the pressed upper foil end, forming one leg of the angle.

Determining Dead Fold Properties of Film Samples

Dead fold retention refers to a measure of the ability of packaging material to retain a fold or crease. The dead fold properties are determined by measuring the re-opening angle of film samples folded under precisely defined conditions. The retained angle (180° minus the opening angle) is the dead fold retention.

The film is conditioned for 24 h in a standard climate of 23° C. and 50% relative humidity before starting the measurement, which is performed under the same conditions.

The film is cut to a piece of 50 mm×50 mm. The film is folded symmetrical along the center and is held for 5 sec between two glass plates (dimensions 80×80 mm having a weight of 44 g each) that cover the entire surface of the film. Subsequently, a weight of 5.56 kg is placed on the upper glass plate resulting a pressure of 5.604 kg/6.25 $cm^2$ respectively 0.89 $kg/cm^2$ on the film between the two glass plates regarding the surface of the folded film sample. The weight and the glass plates are removed after 5 seconds. 30 minutes after removing the weight and the glass plates, the re-opening angle of the folded film is measured using a protractor.

The folding is performed in web direction and transverse to the web direction and the re-opening angle of the respective fold is determined. The dead fold properties are determined for folding towards the surface opposite to the surface comprising the ink-receiving layer. A triplicate determination is performed for each evaluation and the mean value of dead fold angle is determined.

Determining Coefficient of Friction (CoF)

The coefficient of friction is determined according to EN ISO 8295:2004 with a 200 g weight at 100 mm/min drawing speed facing the surface opposite to the surface comprising the ink-receiving layer to itself or facing the overprint varnished ink receiving layer to itself.

The film is conditioned for 24 h in a standard climate of 23° C. and 50% relative humidity before starting the measurement, which is performed under the same conditions.

Determining Electrical Surface Resistivity

The electrical surface resistivity is determined according to IEC 62631-3-2:2015.

The film is conditioned for 24 h in a standard climate of 23° C. and 50% relative humidity before starting the measurement, which is performed under the same conditions.

Determining the Coating Adhesion

A good/excellent coating adhesion is essential to enable the coated film to withstand the twisting and folding operations without deterioration.

The film is fixed on a hard flat surface. A 3-5 cm long strip of an adhesive tape (Tesafilm® 4104 commercially available from Tesa SE (Germany)) is applied on the dried coating or overprint-varnish of the film sample. The tape is pressed to the surface with the help of a 2 kg Standard Finat Roller (commercially available from ZIEGLER Industrie-Elektronik (Germany)). No wrinkles or trapped air bubbles should be present. After 30 seconds, the tape is rapidly removed by hand in an angle of nearly 180°. It is estimated how much of the coating or ink/varnish has been removed by the tape and the result is rated as follows.

(5) Excellent=The coating or ink/varnish has not been affected.
(4) Good=Minimum of the coating or ink/varnish has been removed from the substrate.
(3) Average=Moderate removal of the coating or ink/varnish.
(2) Poor=Severe removal of the coating or ink/varnish.
(1) Very poor=Complete or almost complete removal of the coating or ink/varnish.

Determining the Print Quality

The film samples are taped onto the surface of a thin inkjet coated PET film laminate roll (ARTYSIO Packaging 5402 NW P&P PET DH HFFS 65 W commercially available from Sihl GmbH (Germany)), several meters (approximately 6 m) away from the beginning of the roll. The roll is then installed and fed into an FP-320 printer (commercially available from Afinia Label Ltd (United Kingdom). VersaPass Magenta dye ink (commercially available from Memjet (USA)) is used for printing.

A standard test print file is printed repeatedly at a speed of 9 m/min with a resolution of 1600×1600 dpi using printer settings for a standard glossy coated BOPP Label film. The image printed used appr. 15 ml/m$^2$ of a mixture of all 4 inks which is absorbed into the ink jet receptive coating instantaneously. The image is dry to the touch shortly after leaving the printer.

The print quality is rated regarding bleeding, sharpness, coalescence and color brilliance as follows.

(5) Excellent=No ink bleeding, sharp lines, no coalescence, brilliant colors.
(4) Good=No ink bleeding, only slight enlargement of printed lines and/or slight coalescence in printed areas with high ink loads (secondary and tertiary colors), brilliant colors.
(3) Average=Slight inter-color ink bleeding and/or enlargement of printed lines. and/or coalescence in printed areas with high ink loads (secondary and tertiary colors) and/or less brilliant colors.
(2) Poor=Ink jet ink receptivity is given, but in printed areas with high ink loads (secondary and tertiary colors) inks coalesce and/or colors and contours become blurred and/or dull colors.
(1) Very poor=No ink jet ink receptivity at all, inks coalesce, colors and contours become blurred.

Determining the Rub Resistance

Rub resistance describes the ability of printed surfaces to withstand marking, scuffing or smudging during handling in conversion, packaging, distribution and use. The rub resistance test is performed on printed films after the print is dried. The measurement is performed referring to standard ASTM F13-19-94 (2011).

An ATLAS A.A.T.C.C. crockmeter, Model CM-1 is used. The test sample is clamped onto the base of the crockmeter and a square (50.8 mm×50.8 mm) of a cotton cloth (AATCC crock cloth commercially available from Testfabrics Inc. (USA)) is fixed to a 16 mm diameter acrylic rubbing finger of the crockmeter. The rubbing finger/cotton cloth rests on the sample with a pressure of 900 g force and traverses a straight path of about 100 mm in length with each stroke of the arm.

For the dry rub resistance measurement, the dry cotton cloth is moved back and forth over the printed area of the film sample for 100 times.

For the wet rub resistance measurement, the cotton cloth is immersed in 500 mL of water for 10 min. The cloth is then gently wrung out until it is drip free. The wet cotton cloth is moved back and forth over the printed area of the film sample for 30 or 50 times.

The results are evaluated visually against a comparison standard, which is the respective pristine film tested for abrasion resistance.

Determining Soiling Resistance

A droplet (0.25 ml) of diluted (5 ml of ink on 95 ml water) magenta water-based dye ink (VersaPass magenta dye ink commercially available from Memjet (USA)) is applied on the surface of the overprint varnished printed sample or on the surface of the non-varnished printed sample. After 10 sec, the surface is wiped with a tissue paper to remove the remaining ink. It is recorded and rated how far the droplet penetrates the surface and whether the surfaced is soiled/colored after the wiping with the tissue paper.

Determining Brittleness Properties of Film Samples

The film is conditioned for 24 h in a standard climate of 23° C. and 50% relative humidity before starting the test, which is performed under the same conditions.

The film is cut to pieces of 60 mm×60 mm. The film is folded symmetrical along the center in web direction. The folded piece of film is twisted by hand by 720° (4 half turns) holding the piece of film at the short ends (30 mm ends). The piece of film is untwisted and unfolded and the twisted area is inspected visually with and without the use of a magnifying glass (8 times magnification). The degree of coating detoriation in the sense of cracking of the coating and flaking-off from the film support is rated as follows:

(5) Excellent=No flaking-off of the coating (not printed or printed or printed and over-varnished) from the film support, only slight cracking of the coating, print is not deteriorated.

(4) Good=No flaking-off, but some print deterioration by cracking.

(3) Average=Slight flaking-off and visible print deterioration.

(2) Poor=Severe flaking off and severe print deterioration.

(1) Very poor=Most of the coating (not printed or printed or printed and over-varnished) flakes-off from the film support.

Determining Water Vapor Transmission Rate

The water vapour transmission rate is determined according to ASTM E96-16 (per 24 h at 38° C. and 90% RH).

Preparation of Aqueous Coating Composition I for Ink-Receiving Layer (Microporous Coating Composition)

6 g of 25 wt.-% of hydrochloric acid and 0.8 g of boric acid are added to 500 mL of water in a 2000 mL beaker while stifling. Stirring is continued and 260 g of boehmite (DISPERAL® HP 14, available from Sasol (South Africa)) are added slowly to obtain a dispersion of boehmite particles.

In a separate step, the binder solution is prepared by adding 27 g of polyvinyl alcohol having a degree of hydrolysis of from 86.7 to 88.7 mol % (Mowiol® 40-88, available from Kuraray (Japan)) to 200 g of cold water in a 400 mL beaker while stirring. The suspension is heated to about 90° C. while stirring with a blade agitator until the polyvinyl alcohol is dissolved.

The still hot binder solution is poured into the boehmite dispersion under stirring. Cold water is added under stirring in order to adjust the total volume of the aqueous coating composition to 1000 mL. The composition is stirred for further 30 min and the temperature is decreased to about 45° C. The solid content of the dispersion is about 28.9% by weight with a boehmite to poly(vinyl alcohol) weight ratio of about 9.6:1.

Preparation of Aqueous Coating Composition II for Ink-Receiving Layer (Swellable Coating Composition)

A binder solution is prepared by adding 100 g of polyvinyl alcohol having a degree of hydrolysis of from 86.7 to 88.7 mol % (Mowiol® 40-88, available from Kuraray (Japan)) to 900 g of cold water in a 1500 mL beaker while stirring. The suspension is heated to about 90° C. while stirring with a blade agitator until the polyvinyl alcohol is dissolved. The binder solution is cooled down to room temperature. A solid content of 10% by weight is adjusted by adding water under stirring.

1000 g of the cold binder solution is slowly mixed within 30 min with 1.5 g triethanolamine, 7.9 g of Induquat ECR 956L (35% solids) (commercially available from Indulor Chemie GmbH (Germany)) and 6.8 g of triethylene glycol while stirring with a blade agitator. Stirring is continued for another 30 min. Surfactants and levelling agents are also added. Water is added under stirring to adjust the total mass of the aqueous coating composition to 1115 g. The solid content of the dispersion was about 10% by weight.

Preparation of the Inkjet Printable Twist and/or Fold Wrap Film

Example 1

A non-oriented regenerated compostable cellulose film (NatureFlex™ NK White, 22 μm thick) commercially available from Futamura (Great Britain), coated on both sides with an adhesion promoting layer with barrier properties comprising copolyester and polyvinylidene chloride is used. The still warm aqueous coating composition I is applied uniformly to one surface of the non-oriented film comprising the adhesion promoting layer using a film drawing device from Erickson with a coating bar to obtain an ink-receiving layer having coating weight of about 76 g/m$^2$. Afterwards, the coating is dried in a laboratory drying oven at 90° C. for 5 min to a dry coating weight of 22 g/m$^2$. A high gloss inkjet printable surface is obtained.

Example 2

The same procedure as in Example 1 is performed. Instead of the non-oriented regenerated compostable cellulose film coated on both sides with an adhesion promoting layer with barrier properties, a non-oriented regenerated compostable cellulose film coated on both sides with an adhesion promoting layer without barrier properties (NatureFlex™ NVS White, 22 μm thick), commercially available from Futamura (Great Britain) is used.

Example 3

The same procedure as in Example 1 is performed. Instead of a non-oriented regenerated compostable cellulose film coated on both sides with an adhesion promoting layer with barrier properties, a non-oriented regenerated non-compostable cellulose film coated on both sides with an adhesion promoting with barrier layer comprising polyvinylidene chloride (Star Twist 315 XT, 21.9 μm thick) commercially available from Futamura (Great Britain) is used.

Example 4

The same procedure as in Example 1 is performed. Instead of a non-oriented regenerated compostable cellulose film coated on both sides with an adhesion promoting layer with barrier properties, a non-oriented regenerated non-compostable cellulose film coated on both sides with an adhesion promoting layer with barrier properties comprising a vinylchloride-vinylacetate copolymer (Cellophane™ WSZB, 21.9 μm thick) commercially available from Futamura (Great Britain) is used.

Comparative Example 5

The same procedure as in Example 1 is performed. Instead of a non-oriented regenerated compostable cellulose film coated on both sides with an adhesion promoting layer with barrier properties, a non-coated, non-oriented regenerated compostable cellulose film (NatureFlex™ NPF, 23 μm thick) commercially available from Futamura (Great Britain) is used.

Comparative Example 6

The same procedure as in Example 1 is performed. Instead of a non-oriented regenerated compostable cellulose film coated on both sides with an adhesion promoting layer with barrier properties, a biaxially-oriented non-compostable PET (BOPET, 23 μm thick) film coated on one side with polyacrylate (Sarafil TW 102) commercially available from Polyplex Corporation Ltd. (India) is used.

Comparative Example 7

The same procedure as in Example 1 is performed. Instead of a non-oriented regenerated compostable cellulose film coated on both sides with an adhesion promoting layer with barrier properties, a biaxially-oriented non-compostable polypropylene (BOPP) film having a heat seal layer coextruded on one side (Bicor 30MB344, 30 μm thick) commercially available from Jindal Films (Luxembourg) is used.

Comparative Example 8

The same procedure as in Example 1 is performed. Instead of a non-oriented regenerated compostable cellulose film coated on both sides with an adhesion promoting layer with barrier properties, an uncoated, biaxially-oriented non-compostable PET film (Sarafil Green Wrap Film WGW 181, 23 μm thick; one side corona treated, opposite side anti-static) commercially available from Polyplex Corporation Ltd. (India) is used.

Comparative Example 9

A non-oriented regenerated compostable cellulose film (NatureFlex™ NK White, 22 μm thick) commercially available from Futamura (Great Britain) coated on both sides with an adhesion promoting layer with barrier properties comprising copolyester and polyvinylidene chloride is used. The aqueous coating composition II is applied uniformly to one surface of the non-oriented film comprising the adhesion promoting layer using a lab film drawing device from Erickson with a coating bar to obtain an ink-receiving layer having a coating weight of about 150 g/m$^2$. Afterwards, the coating is dried in a laboratory drying oven at 90° C. for 5 min to a dry coating weight of 15 g/m$^2$. A high gloss inkjet printable surface is obtained.

The properties of the films according to Examples 1 to 9 are determined (see Table 1 and Table 2).

TABLE 1

Examples 1 to 4

| | Ex. 1 | Ex. 2 | Ex. 3 | Ex. 4 |
|---|---|---|---|---|
| Total thickness polymer film [μm] | 43-44 | 47-48 | 43-44 | 43-44 |
| Coating Adhesion | (5) | (5) | (4) | (5) |
| Brittleness | (5) | (5) | (4) | (5) |
| Print Quality | (5) | (5) | (5) | (5) |
| Dead fold retention in web direction/fold to surface opposite the ink-receiving layer [°] | 149 | 144 | 148 | 157 |
| Dead fold retention in transverse web direction/fold to surface opposite the ink-receiving layer [°] | 151 | 146 | 151 | 158 |
| Twist retention [°] | 371 | 366 | 396 | 390 |
| CoF of surface opposite the ink-receiving layer to itself | 0.37 | 0.32 | 0.26 | 0.30 |
| Electrical surface resistivity of surface opposite the ink-receiving layer [MOhm] | 70 | 32 | 40 | 34 |
| Water vapour transmission rate [g/m$^2$/24 hrs] | 20 | 600 | 20 | 350 |

The films according to Examples 1 to 4 show excellent to good coating adhesion, excellent printability with high-speed single pass inkjet printing and provide excellent dead fold and twist retention properties. Moreover, the films according to Examples 1 to 4 have antistatic properties and low CoF values, which guarantee high machinability in packaging machines. The films according to Examples 1, 3 and 4 further provide a good to moderate water vapor barrier. Beneficially, the films according to Examples 1 and 2 are industrially compostable.

TABLE 2

Comparative Examples 5 to 9

| | Ex. 5 | Ex. 6 | Ex. 7 | Ex. 8 | Ex. 9 |
|---|---|---|---|---|---|
| Total thickness polymer film [μm] | 43-44 | 44-45 | 52-53 | 44-45 | 43-44 |
| Coating Adhesion | (2) | (4) | (5) | (3) | (5) |
| Brittleness | (1) | (4) | (5) | (3) | (5) |
| Print Quality | — | (5) | (5) | — | (2) |
| Dead retention fold in web direction [°] | — | 121 | 50 | 128 | 129 |
| Dead fold retention in transverse web direction [°] | — | 124 | 45 | 131 | 136 |
| Twist retention [°] | 260 | 322 | 282 | 384 | 363 |
| CoF of surface opposite the ink-receiving layer to itself | 0.61 | 0.64 | 0.65 | 0.27 | 0.37 |
| Electrical surface resistivity of surface opposite the ink-receiving layer [MOhm] | 280 | $1 \cdot 10^4$ | $4 \cdot 10^6$ | $6 \cdot 10^3$ | 70 |
| Water vapour transmission rate [g/m$^2$/24 hrs] | — | >30 | 4.8 | >20 | 20 |

"—" means "not measured" or "not applicable"

The films according to Examples 5 to 9 do not provide sufficient dead fold and twist retention properties. Especially the film according to Example 7 shows poor dead fold and twist retention properties. The coating adhesion of the film according to Example 5 is poor. The film according to Example 5 is heavily wrinkled and curled and the inkjet receiving layer is brittle, resulting that the film is not printable. The film according to Example 8 is also extremely curled and the inkjet receiving layer is slightly brittle, which limits printing as well as packaging by twisting and folding. The film according to Example 8 further only has a moderate coating adhesion. The film according to Example 9 (swellable inkjet receiving layer) provides only a poor print quality with high-speed single pass inkjet printing.

Comparative Example 10

The pristine non-oriented regenerated compostable cellulose film of Example 1 (without application of an ink-receiving layer) is printed on one side of the adhesion promoting layer with barrier properties. The film according to Example 10 shows very poor print quality.

Preparation of the Inkjet Printed Twist and/or Fold Wrap Film

Example 11 (with Overprint Varnish)

The inkjet printable twist and/or fold wrap film of Example 1 is printed with an ArrowJet Aqua 330R printer (commercially available from Arrow System Inc. (USA)) based on Memjet print head for pigmented inks (DuraFlex; 4 color printing) from roll-to-roll with a resolution of 1600×1600 dpi using printer setting for a standard glossy coated BOPP label film. The image is dry to the touch shortly after leaving the printer. Subsequently, the printed roll is transferred to a flexo printing machine (MarkAndy P3, Gravure Roller 140 L/cm 15.6 $cm^3/m^2$) where an overprint varnish type "Überdrucklack WB50", an aqueous dispersion commercially available at Siegwerk Druckfarben AG & Co. KGa (Siegburg, Germany) is applied onto the top of the printed ink jet coating layer and dried inline by hot air driers at 80° C. Thereby a dry coating weight of the overprint varnish of about 1.5-2.0 $g/m^2$ is achieved.

Example 12 (Without Overprint Varnish)

The same procedure as in Example 11 is performed, instead that no overprint varnish is applied after printing.

The properties of the printed film samples are measured (see Table 3).

TABLE 3

| Examples 11 and 12 | | |
|---|---|---|
| | Ex. 11 | Ex. 12 |
| Total thickness polymer film [μm] | 44.5-46.0 | 43-44 |
| Coating Adhesion | (5) | (4) |
| Brittleness | (5) | (5) |
| Print Quality | (5) | (5) |
| Dry Rub Resistance (100 times) | No colour transfer to the cloth; Image not deteriorated | Slight colour transfer to the cloth; Image is slightly smeared |
| Wet Rub Resistance (30 times) | No colour transfer to the cloth | Total ink transfer to the cloth |
| Wet Rub Resistance (50 times) | Partial colour transfer to the cloth | Complete coating is deteriorated |
| Soiling resistance | No penetration of the ink; No residues of colour on the surface after wiping | Partial penetration of the ink; The coating was stained after wiping |
| Dead fold retention in web direction [°] | 149 | 149 |
| Dead fold retention in transverse web direction [°] | 151 | 151 |
| Twist retention [°] | 360 | 371 |
| CoF of surface opposite the ink-receiving layer to itself | 0.36 | 0.37 |
| CoF of surface on the side of ink-receiving layer (measured to itself) | 0.38 | 0.63 |
| Electrical surface resistivity of surface opposite the ink-receiving layer [MOhm] | 15 | 70 |
| Electrical surface resistivity of surface of the ink-receiving layer [MOhm] | 1000 | 100 |
| Water vapour transmission rate [$g/m^2$/24 hrs] | 20 | 20 |

The films according to Examples 11 and 12 show excellent coating adhesion, excellent printability with high-speed single pass inkjet printing, and provide excellent dead fold and twist retention properties. The film according to Example 11 shows improved rub resistance and soiling resistance compared to the film according to Example 12. The printed surface of Example 11 will not be marked, scuffed or smudged when the surface is in moving contact with other surfaces, such as during processing, packaging or distribution. The coated surface of Example 11 is resistant when in contact with water or condensed moisture, such as in packaging for frozen or chilled food. In addition, the printed and overprint varnished surface of Example 11 provides a CoF value, which allows high speed processing in packaging machines.

The invention claimed is:

1. An inkjet printable twist and/or fold wrap film for packaging applications comprising:

(a) a non-oriented polymer film, wherein the non-oriented polymer film (a) is a regenerated cellulose film;

(b) at least one ink-receiving layer comprising inorganic particles and a binder coated over one surface of the non-oriented polymer film (a) at a dry coating weight being in the range of from 8 to 30 $g/m^2$; and (c) an adhesion promoting layer between the non-oriented polymer film (a) and the at least one ink-receiving layer (b).

2. The inkjet printable twist and/or fold wrap film according to claim 1, wherein the inkjet printable twist and/or fold wrap film without the ink-receiving layer has a film thickness in the range of from 15 to 50 μm; and/or wherein the non-oriented polymer film (a) is transparent, translucent, metallized or opaque; and/or wherein the adhesion promoting layer (c) comprises (co) polyester; polyvinylidene chloride; vinylchloride vinylacetate copolymer; (meth)acrylic (co)polymer; nitrocellulose; ethylene acrylic acid copolymer; or copolymers or combinations thereof.

3. The inkjet printable twist and/or fold wrap film according to claim 1, wherein the inorganic particles comprise aluminum oxide particles, aluminum hydroxide particles, silica particles, or combinations thereof; and/or wherein the binder comprises polyvinyl alcohol; polyvinyl alcohol derivatives; polyethylene oxide; polyvinylmethylether; cellulose derivatives; polyvinylpyrrolidone; polymer dispersions or emulsions; or combinations thereof; and/or wherein the ink-receiving layer (b) comprises the inorganic particles and the binder in a weight ratio ranging from 2:1 to 20:1.

4. The inkjet printable twist and/or fold wrap film according to claim 1, further comprising a barrier layer positioned between the non-oriented polymer film (a) and the ink-receiving layer (b) and/or over the surface of the non-oriented polymer film (a) opposite to the surface over which the ink-receiving layer (b) is formed;

and/or further comprising a sealing layer positioned over the surface of the non-oriented polymer film (a) opposite to the surface over which the ink-receiving layer (b) is formed.

5. The inkjet printable twist and/or fold wrap film according to claim 1, having a twist retention of more than 350° and/or a dead fold retention of at least 100°.

6. The inkjet printable twist and/or fold wrap film according to claim 1, having a thickness of from 20 to 100 μm; and/or comprising up to 50 wt.-% of the ink-receiving layer (b), based on the total weight of the inkjet printable twist and/or fold wrap film; and/or being industrially compostable and/or home compostable.

7. A method for preparing the inkjet printable twist and/or fold wrap film according to claim 1, comprising the steps:

(a) providing a non-oriented polymer film being a regenerated cellulose film;

(b) applying an adhesion promoting layer over at least a part of one surface of the non-oriented film (a);

(c) coating the surface of the non-oriented polymer film comprising the adhesion promoting layer (b) with a ink-receiving layer composition comprising inorganic particles and a binder at a dry coating weight being in the range of 8 to 30 g/m$^2$.

8. An inkjet printed twist and/or fold wrap film obtained by printing of an inkjet printable twist and/or fold wrap film comprising: (a) a non-oriented polymer film, wherein the non-oriented polymer film (a) is a regenerated cellulose film; (b) at least one ink-receiving layer comprising inorganic particles and a binder coated over one surface of the non-oriented polymer film (a) at a dry coating weight being in the range of from 8 to 30 g/m$^2$; (c) an adhesion promoting layer between the non-oriented polymer film (a) and the at least one ink-receiving layer (b); and (d) and overprint varnish layer as an outer layer over the printed ink-receiving layer (b); or prepared by (a) providing a non-oriented polymer film being a regenerated cellulose film; (b) applying an adhesion promoting layer over at least a part of on surface of the non-oriented film (a); (c) coating the surface of the non-oriented polymer film comprising the adhesion promoting layer (b) with a ink-receiving layer composition comprising inorganic particles and a binder at a dry coating weight being in the range of 8 to 30 g/m$^2$ and further applying an overprint varnish layer (d) as an outer layer over the printed ink-receiving layer (b).

9. The inkjet printed twist and/or fold wrap film according to claim 8, printed by inkjet printing; and/or wherein the overprint varnish layer (d) has a thickness of 0.5 to 5 μm.

10. The inkjet printed twist and/or fold wrap film according to claim 8, having a twist retention of more than 350° and/or a dead fold retention of at least 100°; and/or exhibiting a coefficient of friction (CoF) film to film of the surface on the side of the ink-receiving layer to itself and/or the surface opposite to the side of the ink receiving layer to itself of less than 0.45.

11. A method for preparing the inkjet printed twist and/or fold wrap film according to claim 8, comprising the steps:

(a) providing an inkjet printable twist and/or fold wrap film comprising: (a) a non-oriented polymer film, wherein the non-oriented polymer film (a) is a regenerated cellulose film; (b) at least one ink-receiving layer comprising inorganic particles and a binder coated over one surface of the non-oriented polymer film (a) at a dry coating weight being in the range of from 8 to 30 g/m$^2$; (c) an adhesion promoting layer between the non-oriented polymer film (a) and the at least one ink-receiving layer (b); and (d) and overprint varnish layer as an outer layer over the printed ink-receiving layer (b); or prepared by (a) providing a non-oriented polymer film being a regenerated cellulose film; (b) applying an adhesion promoting layer over at least a part of on surface of the non-oriented film (a); (c) coating the surface of the non-oriented polymer film comprising the adhesion promoting layer (b) with a ink-receiving layer composition comprising inorganic particles and a binder at a dry coating weight being in the range of 8 to 30 g/m$^2$;

(b) printing of the ink-receiving layer of the inkjet printable twist and/or fold wrap film; and (c) applying an overprint varnish as an outer layer over the printed ink-receiving layer.

12. A packaging comprising the inkjet printable twist and/or fold wrap flexible film according to claim 1.

13. The packaging of claim 12, wherein the packaging comprises a packaging for food, pet food, beverages, pharmaceuticals and/or personal care products.

14. A method of making a filled packaging comprising the steps of:

(i) providing the inkjet printed twist and/or fold wrap film according to claim 8;

(ii) positioning goods onto the inkjet printed twist and/or wrap film;

(iii) wrapping the goods with the inkjet printed twist and/or wrap film and closing the wrapping by means of twisting or folding the inkjet printed twist and/or wrap film around the goods; and (iv) optionally partially sealing the packaging film.

15. A packaging comprising the inkjet printed twist and/or fold wrap film according to claim 8.

16. The packaging of claim 15, wherein the packaging comprises a packaging for food, pet food, beverages, pharmaceuticals and/or personal care products.

17. A method of making a filled packaging comprising the steps of:

(i) providing the inkjet printed twist and/or fold wrap film prepared by the method according to claim 11;

(ii) positioning goods onto the inkjet printed twist and/or wrap film;

(iii) wrapping the goods with the inkjet printed twist and/or wrap film and closing the wrapping by means of twisting or folding the inkjet printed twist and/or wrap film around the goods; and (iv) optionally partially sealing the packaging film.

* * * * *